US008210336B2

(12) United States Patent
Nishida

(10) Patent No.: US 8,210,336 B2
(45) **Date of Patent: *Jul. 3, 2012**

(54) COIN DEPOSITING AND DISPENSING MACHINE

(75) Inventor: Eisei Nishida, Himeji (JP)

(73) Assignee: Glory Ltd., Himeji-Shi, Hyogo (JP)

( * ) Notice: Subject to any disclaimer, the term of this patent is extended or adjusted under 35 U.S.C. 154(b) by 777 days.

This patent is subject to a terminal disclaimer.

(21) Appl. No.: 12/067,349

(22) PCT Filed: Sep. 11, 2006

(86) PCT No.: PCT/JP2006/317956

§ 371 (c)(1),
(2), (4) Date: Mar. 19, 2008

(87) PCT Pub. No.: WO2007/034699

PCT Pub. Date: Mar. 29, 2007

(65) Prior Publication Data

US 2009/0047888 A1 Feb. 19, 2009

(30) Foreign Application Priority Data

Sep. 21, 2005 (JP) ..... 2005-273657

(51) Int. Cl.
*G07D 1/00* (2006.01)
*G07D 13/00* (2006.01)
*G07F 1/00* (2006.01)

(52) U.S. Cl. ..... 194/302; 194/344; 453/57

(58) Field of Classification Search ..... 194/302, 194/344, 350; 453/18, 56, 57
See application file for complete search history.

(56) References Cited

U.S. PATENT DOCUMENTS 3,698,537 A * 10/1972 Black et al. ..... 453/57
4,558,711 A * 12/1985 Yoshiaki et al. ..... 453/3
4,635,661 A * 1/1987 Uematsu et al. ..... 194/217
(Continued)

FOREIGN PATENT DOCUMENTS

EP 1679667 7/2006
(Continued)

OTHER PUBLICATIONS

Supplementary European Search Report (dated Jul. 13, 2010—2 pages).

(Continued)

*Primary Examiner* — Mark Beauchaine
(74) *Attorney, Agent, or Firm* — Renner, Kenner, Greive, Bobak, Taylor & Weber

(57) ABSTRACT

A compact coin depositing and dispensing machine is provided with a cyclic conveying device. The conveying device conveys, one by one, coins, accepted in a coin acceptance port, in a depositing and conveying direction, and conveys, one by one, coins, to be ejected to a coin ejection port, in a dispensing and conveying direction reverse the depositing and conveying direction. A plurality of accommodating and ejecting units are disposed along the conveying device. Because each accommodating and ejecting unit outputs and inputs coins to and from the conveying device through the same coin outlet/inlet, a depositing and conveying path and a dispensing and conveying path of the conveying device can be arranged as a common path. Each accommodating and ejecting unit accommodates coins in a non-aligned state and ejects accommodated coins one by one to the conveying device.

11 Claims, 23 Drawing Sheets

U.S. PATENT DOCUMENTS

| | | | | |
|---|---|---|---|---|
| 5,114,381 | A * | 5/1992 | Ueda et al. | 453/57 |
| 7,255,639 | B2 * | 8/2007 | Abe et al. | 453/18 |
| 2003/0201146 | A1 * | 10/2003 | Abe et al. | 194/302 |

FOREIGN PATENT DOCUMENTS

| | | |
|---|---|---|
| GB | 2 386 734 | 9/2003 |
| JP | 58-190766 | 12/1983 |
| JP | 60-163193 | 8/1985 |
| JP | 6-274740 | 9/1994 |
| JP | 10-228556 | 8/1998 |
| JP | 2001-043420 | 2/2001 |
| JP | 2002-260067 | 9/2002 |
| JP | 2004-341676 | 12/2004 |
| JP | 2004-355581 | 12/2004 |
| JP | 3708373 | 10/2005 |
| JP | 2006-190009 | 7/2006 |
| WO | 2007/034699 | 3/2007 |

OTHER PUBLICATIONS

Office Action corresponding to JP 2007-536452 and English Translation (7 pages—dated Jan. 4, 2012).
English Abstract of JP 60-163193 (1 page—undated).

* cited by examiner (a)

(b)

(a)

(b)

(a)

(b)

(a)

(b)

(a)

(b)

COIN DEPOSITING AND DISPENSING MACHINE

CROSS REFERENCE TO RELATED APPLICATIONS

This is a U.S. national phase application under 35 U.S.C. §371 of International Patent Application No. PCT/JP2006/317956, filed Sep. 11, 2006 and claims the benefit of Japanese Application 2005-273657, filed Sep. 21, 2005. The International Application was published in Japanese on Mar. 29, 2007 as International Publication No. WO 2007/034699 under PCT Article 21 (2) the contents of which are incorporated herein in their entirety.

TECHNICAL FIELD

The present invention relates to a coin depositing and dispensing machine enabling depositing and dispensing of coins.

BACKGROUND ART

Coin depositing and dispensing machines, electrically connected to a POS cash register, an electronic cash register, a teller management machine, or other cashier equipment and enabling depositing and dispensing of cash to be performed automatically according to electrical signals from such cashier equipment, have been developed from before for performing cash transactions with customers accurately and rapidly at a cash register in a store or, in a case of a financial institution, at a counter or an ATM (automatic teller machine) installed inside or outside a financial outlet.

With such a coin depositing and dispensing machine, coins deposited by a customer are received and accommodated by a depositing and dispensing member disposed at an upper depositing and dispensing position, the coins are fed from the depositing and dispensing member to a rotating disk for depositing, the coins are fed one by one from the rotating disk to a coin sorting passage, and while being conveyed along the coin sorting passage, denominations are identified by an identifying unit and the coins are conveyed to and accommodated in coin pooling cylinders corresponding to the respective denominations.

When coins are to be dispensed to a customer, dispensed coins necessary for dispensing are released from the respective coin pooling cylinders to a conveyor belt, the conveyor belt is rotated to feed the dispensed coins to a rotating disk for dispensing, the rotating disk is rotated to feed the dispensed coins to the depositing and dispensing member that has been moved in advance to a lower dispensing position, and the depositing and dispensing member is raised to the upper depositing and dispensing position by a lifting and lowering mechanism to enable the dispensed coins to be taken out from the depositing and dispensing member (see, for example, Japanese Patent No. 3708373 (pages 8 to 11, FIGS. 8 to 13)). There is also an example, which, in place of using coin pooling cylinders, uses denomination-specific pooling hopper units, each constituted of a tilted disk and a pooling hopper, pooling coins between itself and a top face of the tilted disk, and with this arrangement, coins sent out by the tilted disks of the denomination-specific pooling hopper units are released onto a conveyor aligned in a direction of alignment of the denomination-specific pooling hopper units and fed through the conveyor to a coin transaction port facing a terminal end of the conveyor (see, for example, Japanese Laid-Open Utility Model Publication No. 58-190766 (pages 6 to 7, FIG. 2)).

BACKGROUND OF THE INVENTION

As a circumstance surrounding coin depositing and dispensing machines used in coin register change machines for stores and in financial institutions, there has been an increasing demand for coin depositing and dispensing machines that are more compact than conventional machines.

However, with the conventional coin depositing and dispensing machine, in the depositing process, coins are conveyed to the coin pooling cylinders via the rotating disk for depositing and the coin identifying passage and, in the dispensing process, the dispensed coins are fed into the depositing and dispensing member disposed at the lower dispensing position via the rotating disk for dispensing. Because the coin passages used in the depositing process and the dispensing process thus differ, it is difficult to make the machine body compact.

Furthermore, the provision of the lifting and lowering mechanism that positions the depositing and dispensing member at the upper depositing and dispensing position and the lower dispensing position is a factor that impedes the making of the machine body compact.

In the case where denomination-specific pooling hopper units are used, unlike coin pooling cylinders, coins do not have to be accommodated in an aligned, stacked manner but can be accommodated in a non-aligned manner, and there is thus the merit that accommodation of coins is easy.

However, because coins sent out from the denomination-specific pooling hopper units are released directly onto the conveyor and sent out to the coin transaction port facing the terminal end of the conveyor, even if the coins sent out from the denomination-specific pooling hopper units can be counted in the process of being sent out from the denomination-specific pooling hopper units, identification of the coins cannot be performed, and for example, severely worn coins not suited for dispensing, counterfeit coins, and other coins that should not be dispensed are dispensed as coins to be dispensed. However, if such coins that should not be dispensed are to be prevented from being dispensed, a rotating disk for dispensing must be disposed at the terminal end of the conveyer as in the above-described case of using the coin pooling cylinders, the dispensed coins must be fed to a coin passage one by one from the rotating disk, the dispensed coins must be identified on the coin passage, and coins that should not be dispensed must be diverged in the middle of the coin passage so that only coins that should be dispensed are sent out from the terminal end of the coin passage. Thus as in the above-described case of using coin pooling cylinders, it is difficult to make the machine body compact.

The present invention has been made in view of these points and an object thereof is to provide a compact coin depositing and dispensing machine.

SUMMARY OF THE INVENTION

A coin depositing and dispensing machine according to the present invention includes: a coin acceptance port, accepting coins from the outside of the machine body; a coin ejection port, from which coins are ejected to the outside of the machine body; a conveying means, conveying, one by one, coins accepted from the coin acceptance port and coins to be ejected to the coin ejection port; an identifying unit, identifying types of coins conveyed by the conveying means; and an accommodating and ejecting unit, having a rotating disk, rotatable in a tilted orientation in which an upper portion is tilted toward a back face direction, a hopper, accommodating coins at a top face side of the rotating disk, and a coin outlet, through which coins are sent out from an upper circumferential region of the rotating disk to the conveying means, and accepting, in accordance with identification results of the identifying unit, coins accepted in the coin acceptance port from the outside of the machine body, accommodating the accepted coins in a non-aligned state, and ejecting the accommodated coins, one by one, from the coin outlet.

Because the accommodating and ejecting unit is provided with the tilted disk and the hopper, there is no need to accommodate coins in an aligned, stacked manner as in a coin pooling cylinder and coins can be accommodated in a non-aligned state. The coins in the accommodating and ejecting unit are ejected one by one from the coin outlet to the conveying means, and the coins conveyed one by one by the conveying means are identified by the identifying unit, thereby enabling just the dispensed coins that are judged to be coins suitable for dispensing to be sent out rapidly to the coin ejection port.

A coin depositing and dispensing machine according to the present invention also includes: a coin acceptance port, accepting coins from the outside of the machine body; a coin ejection port, from which coins are ejected to the outside of the machine body; a conveying means, conveying, one by one, coins accepted from the coin acceptance port and coins to be ejected to the coin ejection port; an identifying unit, identifying types of coins conveyed by the conveying means; and an accommodating and ejecting unit, having a coin outlet/inlet through which coins are output or input to or from the conveying means, accepting, in accordance with identification results of the identifying unit, coins accepted in the coin acceptance port from the outside of the machine body, accommodating the accepted coins in a non-aligned state, and ejecting the accommodated coins, one by one, from the coin outlet/inlet.

Because coins accepted into the coin acceptance port from the outside of the machine body are conveyed one by one by the conveying means, the conveyed coins are accepted one by one from the coin outlet/inlet of the accommodating and ejecting unit according to the identification results of the identifying unit and accommodated in the non-aligned state in the accommodating and ejecting unit, and the coins ejected one by one from the coin outlet/inlet of the accommodating and ejecting unit are conveyed one by one by the conveying means and ejected to the coin ejection port, a depositing and conveying path and a dispensing and conveying path can be arranged as a common path.

With a coin depositing and dispensing machine according to the present invention, the coin depositing and dispensing machine of the invention furthermore includes: a pooling and feeding unit, receiving, accommodating, and pooling coins, accepted into the coin accepting port from the outside of the machine body, and feeding the pooled coins one by one to the conveying means.

The coins accepted into the coin accepting port from the outside of the machine body are thereby fed one by one from the pooling and feeding unit to the conveying means to enable processes of identifying and accommodating the coins.

With a coin depositing and dispensing machine according to the present invention, the coin depositing and dispensing machine of the invention furthermore includes: a temporary storage unit, temporarily storing coins; and a controller, making coins, which, among the coins accepted into the coin accepting port from the outside of the machine body, are identified as normal coins by the identifying unit, be temporarily stored in the temporary storage unit until approval and confirmation of depositing and making the stored coins be fed from the temporarily storage unit after approval and confirmation of depositing.

By temporarily storing the coins, which, among the coins accepted into the coin accepting port from the outside of the machine body, are identified as normal coins by the identifying unit, in the temporary storage unit, approval and confirmation of the deposited coins are enabled.

With a coin depositing and dispensing machine the present invention, the coin depositing and dispensing machine furthermore includes: a controller, driving the conveying means in a first direction when coins are fed from the pooling and feeding unit and accommodated in the accommodating and ejecting unit, and driving the conveying means in a second direction, differing from the first direction, when coins are fed from the accommodating and ejecting unit and ejected to the coin ejection port.

Coins can be fed from the storage and feeding unit and accommodated in the accommodating and ejecting unit and coins can be fed from the accommodating and ejecting unit and ejected to the coin ejection port by changing the directions in which the conveying means is driven, thus enabling the depositing and conveying path and the dispensing and conveying path to be arranged as a common path.

With a coin depositing and dispensing machine according to the present invention, the coin depositing and dispensing machine furthermore includes: a sorting member, sorting coins, conveyed by the conveying means, with respect to the accommodating and ejecting unit in accordance with the identification results of the identifying unit.

Coins, conveyed by the conveying means, are sorted to the accommodating and ejecting unit by the sorting member.

With a coin depositing and dispensing machine to the present invention, in the coin depositing and dispensing machine, the conveying means includes: a first passage portion, disposed from one side toward another side of the machine body; a return passage portion, returning from a terminal end of the first passage portion toward the one side of the machine body; and a second passage portion, disposed from a terminal end of the return passage portion toward the one side of the machine body and having a terminal end facing the coin ejection port; the identifying unit is disposed in the first passage portion, and a plurality of the accommodating and ejecting units are disposed in the first passage portion at a downstream side in the conveying direction with respect to the identifying unit when the conveying means is driven in the first direction.

Because the conveying means is provided with a layout having the first passage portion, the return passage portion, and the second passage portion, and the identifying unit and the plurality of accommodating and ejecting units are disposed in the first passage portion sequentially along the conveying direction when the conveying means is driven in the first direction, the coin depositing and dispensing machine can be downsized.

With a coin depositing and dispensing machine according to the present invention, in the coin depositing and dispensing machine, an accommodating and ejecting unit is also disposed in the second passage portion.

Because an accommodating and ejecting unit is also disposed in the second passage portion and the accommodating and ejecting units are disposed allocatedly in the first passage portion and the second passage portion, a dimension of the machine body in a direction from the one side to the other side is made short. With a coin depositing and dispensing machine according to the present invention, in the coin depositing and dispensing machine, the identifying unit is disposed in the first passage portion, and a rejection sorting mechanism, sorting out coins not identified as being normal coins according to the identification results of the identifying unit, is disposed at a downstream side in a conveying direction from the identifying unit when the conveying means is driven in the first direction.

The coins that are not identified as being normal coins according to the identification result of the identifying unit are sorted out by the rejection sorting mechanism and only the normal coins are conveyed to the downstream side in the conveying direction. With a coin depositing and dispensing machine according to the present invention, in the coin depositing and dispensing machine the conveying means includes a cyclic coin passage; and an endless conveyor, enabled to move along the coin passage and having a plurality of projections, pushingly conveying coins one by one in the coin passage.

By the plurality of projections provided on the endless conveyor that moves along the cyclic coin passage, the coins in the coin passage can be conveyed pushingly one by one.

With a coin depositing and dispensing machine according to the present invention, the coin depositing and dispensing machine furthermore includes: a memory unit, memorizing numbers of coins according to type; and a controller, performing, with the pooling and feeding unit and the accommodating and ejecting unit, mutually between which coins can be moved by the conveying means and through the identifying unit, a detailed check of a number of coins accommodated in the accommodating and ejecting unit by making coins be fed one by one from the accommodating and ejecting unit, the fed coins be identified by the identifying unit and memorized by the memory unit, the identified coins be accommodated in the pooling and feeding unit, and, after all of the coins in the accommodating and ejecting unit have been moved to the pooling and feeding unit, all of the coins in the pooling and feeding unit be fed one by one and accommodated back in the accommodating and ejecting unit.

Thus with the pooling and feeding unit and the accommodating and ejecting unit, mutually between which coins can be moved by the conveying means and through the identifying unit, by making the coins in the accommodating and ejecting unit be identified by the identifying unit while being moved to the pooling and feeding unit and thereafter moving the coins in the pooling and feeding unit back to the accommodating and ejecting unit, the number of coins accommodated in the accommodating and ejecting unit can be subject to a detailed check.

Effects of the Invention

With the coin depositing and dispensing machine according to the present invention, because the accommodating and ejecting unit is provided with the tilted disk and the hopper, there is no need to accommodate the coins in an aligned, stacked manner as in a coin pooling cylinder and the coins can thus be accommodated easily in a non-aligned state, the coins in the accommodating and ejecting unit can be ejected one by one from the coin outlet to the conveying means, the coins conveyed one by one by the conveying means can be identified by the identifying unit to enable just the dispensed coins that are judged to be coins suitable for dispensing to be fed rapidly to the coin ejection port, and a compact, coin depositing and dispensing machine, can thus be provided with which a rotating disk for depositing, such as that in the conventional arrangement, is not needed.

With the coin depositing and dispensing machine according to the present invention, because coins can be output and input to the conveying means from the same coin outlet/inlet of the accommodating and ejecting unit, the depositing and conveying path and the dispensing and conveying path can be arranged as a common path and a compact coin deposition and dispensing machine can be provided. Also, because in the accommodating and ejecting unit, the coins are accommodated in a non-aligned manner, the coins do not become erected, etc. and accommodated improperly as in a case where the coins are stackingly accommodated in a cylinder, and the accommodation and ejection of the coins can be performed reliably.

With the coin depositing and dispensing machine,the present invention, in addition to providing the effects of the coin depositing and dispensing machine, the coins accepted into the coin accepting port from the outside of the machine body can be received, accommodated, and pooled in the pooling and feeding unit, and the coins pooled in the pooling and feeding unit can be fed one by one to the conveying means and be subject to the processes of identification and accommodation.

With the coin depositing and dispensing machine, the present invention, in addition to providing the effects of the coin depositing and dispensing machine,by temporarily storing, in the temporary storage unit, the coins, which, among the coins accepted into the coin accepting port from the outside of the machine body, are identified as normal coins by the identifying unit, approval and confirmation of depositing are enabled, and after approval and confirmation of depositing, the stored coins can be fed from the temporary storage unit and be subject to the processes of accommodation and returning.

With the coin depositing and dispensing machine according to the present invention, in addition to providing the effects of the coin depositing and dispensing machine, the conveying means is driven in the first direction when coins are fed from the pooling and feeding unit and accommodated in the accommodating and ejecting unit, the conveying means is driven in the second direction differing from the first direction when coins are fed from the accommodating and ejecting unit and ejected to the coin ejection port, and the processes of depositing and dispensing can thus be performed with the depositing and conveying path and the dispensing and conveying path being arranged as a common path.

With the coin depositing and dispensing machine according to the present invention, in addition to providing the effects of the coin depositing and dispensing machine, the coins, conveyed by the conveying means, can be sorted to the accommodating and ejecting unit by the sorting member.

With the coin depositing and dispensing machine according to the present invention, in addition to providing the effects of the coin depositing and dispensing machine, because the conveying means is provided with the layout including: the first passage portion, disposed from one side toward the other side of the machine body; the return passage portion, returning from the terminal end of the first passage portion toward the one side of the machine body; and the second passage portion, disposed from the terminal end of the return passage portion toward the one side of the machine body and having a terminal end facing the coin ejection port, and the identifying unit and the plurality of accommodating and ejecting units are disposed in the first passage portion sequentially along the conveying direction when the conveying means is driven in the first direction, the coin depositing and dispensing machine can be downsized.

With the coin depositing and dispensing machine according to the present invention, in addition to providing the effects of the coin depositing and dispensing machine, an accommodating and ejecting unit is also disposed in the second passage portion, the accommodating and ejecting units are thus disposed allocatedly between the first passage portion and the second passage portion, and the dimension of the machine body in the direction from the one side to the other side can thus be made short.

With the coin depositing and dispensing machine according to the present invention, in addition to providing the effects of the coin depositing and dispensing machine, the coins that are not identified as being normal coins according to the identification results of the identifying unit are sorted out by the rejection sorting mechanism disposed at the downstream side in the conveying direction from the identifying unit when the conveying means is driven in the first direction, enabling only the normal coins to be conveyed to the downstream side in the conveying direction.

With the coin depositing and dispensing machine according to of the present invention, in addition to providing the effects of the coin depositing and dispensing machine, by the plurality of projections provided on the endless conveyor that moves along the cyclic coin passage, the coins in the coin passage can be conveyed pushingly one by one.

With the coin depositing and dispensing machine according to the present invention, in addition to providing the effects of the coin depositing and dispensing machine, by making, with the pooling and feeding unit and the accommodating and ejecting unit, mutually between which coins can be moved by the conveying means and through the identifying unit, coins be fed one by one from the accommodating and ejecting unit, the fed coins be identified by the identifying unit and memorized by the memory unit, the identified coins be accommodated in the pooling and feeding unit, and after all of the coins in the accommodating and ejecting unit have been moved to the pooling and feeding unit, all of the coins in the pooling and feeding unit be fed one by one and accommodated back in the accommodating and ejecting unit, the number of coins accommodated in the accommodating and ejecting unit can be subject to a detailed check.

DETAILED DESCRIPTION OF THE INVENTION

The present invention shall now be described with reference to the drawings.

FIGS. 1 to 10 show a first embodiment.

Figure 1:
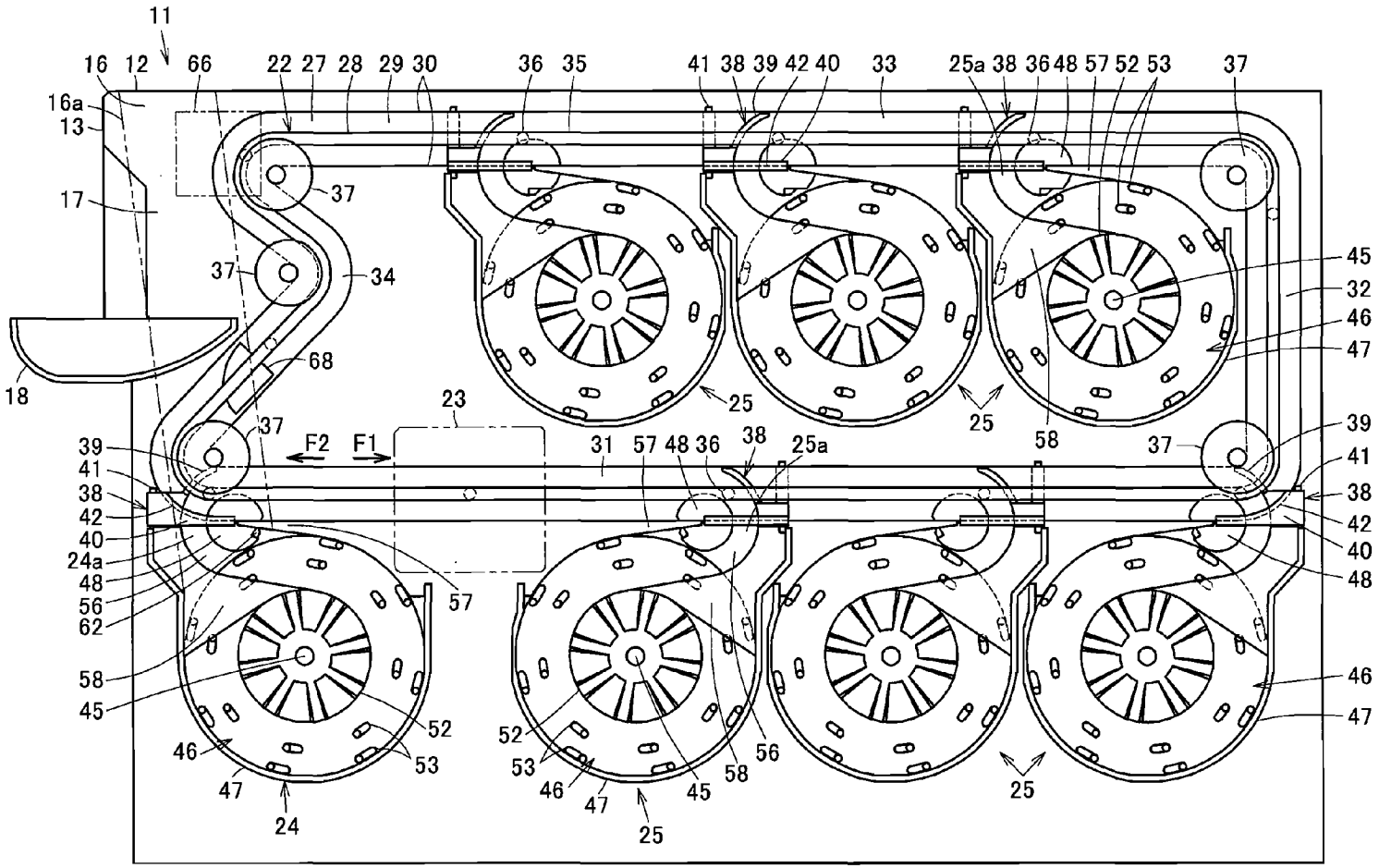
[FIG. 1] is a side view of an internal structure of a coin depositing and dispensing machine according to a first embodiment of the present invention.
Figure 2:
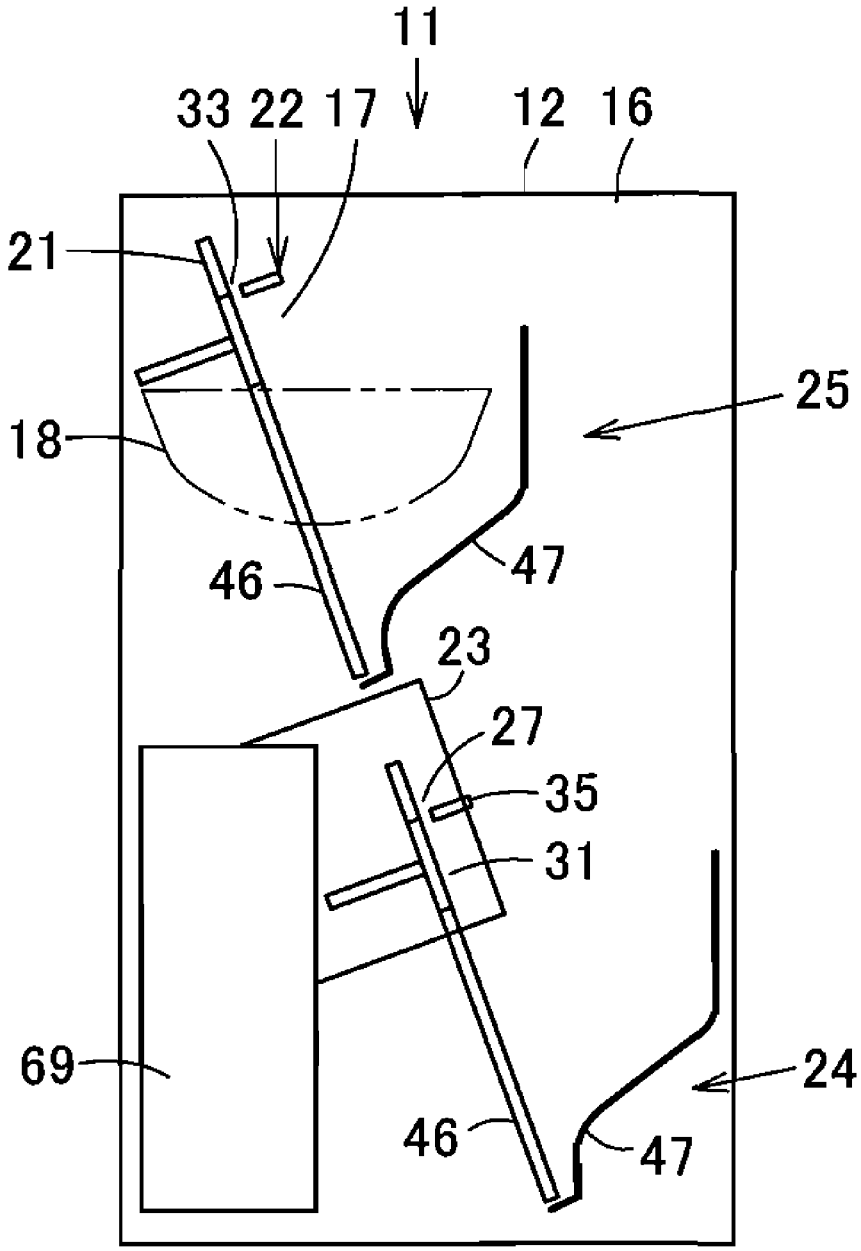
[FIG. 2] is a front view of the internal structure of the same coin depositing and dispensing machine.

As shown in FIGS. 1 and 2, a coin depositing and dispensing machine 11 has a machine body 12, and on a front face (left side in FIG. 1) of the machine body 12 is formed an operation surface 13 on which a customer performs an operation of inputting deposited coins and an operation of taking out dispensed coins. On the operation surface 13 of the machine body 12, a coin acceptance port 16, through which deposited coins, etc. are input into the machine body 12, and a coin ejection port 17, from which dispensed coins, etc. are ejected out of the machine body 12, are disposed side by side in a left/right direction as viewed from the front face of the machine body, and a receptacle 18, receiving coins ejected from the coin ejection port 17, is furthermore disposed.

Inside the machine body 12 is disposed a base 21, an upper portion of which is tilted at a predetermined angle to a left side as viewed from the machine body front face (in the direction of a rear face of a base 21). On a top face side of the base 21 facing the upper side are disposed a conveying means 22, conveying coins, an identifying unit 23, identifying types of coins conveyed by the conveying means 22, a pooling and feeding unit 24, accepting coins input into the coin acceptance port 16, feeding coins one by one onto the conveying means 22, and enabled to output and input coins one by one to and from the conveying means 22, and a plurality of accommodating and ejecting units 25, accommodating coins according to type and enabled to output and input coins one by one to and from the conveying means 22, etc. Between the coin acceptance port 16 and the pooling and feeding unit 24 is disposed a chute 16*a*, guiding the coins, input into the coin acceptance port 16, to the pooling and feeding unit 24. A coin accommodation and ejection device is constituted by the conveying means 22, the accommodating and ejecting units 25, etc.

The conveying means 22 has a cyclic coin passage 27, putting coins in a single file state and guiding the conveying of the coins, and an endless conveyor 28, conveying the coins in the coin passage 27.

The coin passage 27 has a passage face 29, formed on the top face of the base 21 and contacting faces of coins, and guiding side plates 30 at both sides, guiding circumferences of the coins at both sides of the passage face 29. Along the coin passage 27 are formed a first passage portion 31, disposed from a front side toward a rear side of the machine body 12, a return passage portion 32, returning from a terminal end of the first passage portion 31 toward the front side of the machine body 12, a second passage portion 33, disposed from a terminal end of the return passage portion 32 toward the front side of the machine body 12 and having a terminal end facing the coin ejection port 17, and a reverting passage portion 34, connected from the terminal end of the second passage portion 33 to a starting end of the first passage portion 31.

The conveyor 28 is constituted of an endless belt 35. From a face of the belt 35 opposing the passage face 29, a plurality of projections 36 are projected at a predetermined pitch in a longitudinal direction of the belt. The belt 35 is tensioned across a plurality of pulleys 37 so as to rotate through a central region of the coin passage 27. A coin is accepted between two adjacent projections 36 of the belt 35 and the coin is conveyed by being pushed by the projections 36 in accordance with the rotation of the belt 35.

One of the pulleys 37 is driven to rotate forward and in reverse by a motor. That is, in a depositing process, in which coins are fed from the pooling and feeding unit 24 and accommodated in the accommodating and ejecting units 25, the belt 35 is driven in a first direction (hereinafter referred to as the "depositing and conveying direction F1"), which is a forward direction, so as to move from the front side toward the rear side in the first passage portion 31, and in a dispensing process, in which coins are fed from the accommodating and ejecting units 25 and ejected to the coin ejection port 17, the belt 35 is driven in a second direction (hereinafter referred to as the "dispensing and conveying direction F2"), which is a reverse direction with respect to the depositing and conveying direction F1. Thus by forward and reverse drive of the belt 35, coins in the coin passage 27 can be conveyed in both the forward and reverse directions.

The pooling and feeding unit 24 is disposed at a front side position at a lower side of the first passage portion 31 of the coin passage 27, and a plurality, for example, three of the accommodating and ejecting units 25 are disposed at positions along the first passage 31 to the rear of the pooling and feeding unit 24. At a lower side of the second passage portion 33, a plurality, for example, three of the accommodating and ejecting units 25 are disposed along the second passage portion 33. The identifying unit 23 is disposed between the pooling and feeding unit 24 and the foremost accommodating and ejecting unit 25 at the first passage portion 31.

A coin outlet/inlet 24*a* of the pooling and feeding unit 24, enabling coins to be output and input to and from the coin passage 27, is formed by opening a portion of the lower guiding side plate 30 of the first passage portion 31. Coin outlet/inlets 25*a* of the respective accommodating and ejecting units 25, enabling coins to be output and input to and from the coin passage 27, are formed by opening portions of the lower guiding side plates 30 at the respective passage portions 31 and 33.

At positions of the coin passage 27 at the coin outlet/inlet 24*a* and the respective coin outlet/inlets 25*a* are disposed sorting members 38 that selectively sort coins according to whether a coin is to be output or input through the coin outlet/inlet 24*a* and the respective coin outlet/inlets 25*a* or whether a coin being conveyed by the conveying means 22 is to be passed to a downstream side in the conveying direction. The respective sorting members 38 for the pooling and feeding unit 24 and the respective accommodating and ejecting units 25 differ only in direction, etc. and are formed to be the same in a basic arrangement for sorting the coins.

Figure 3:
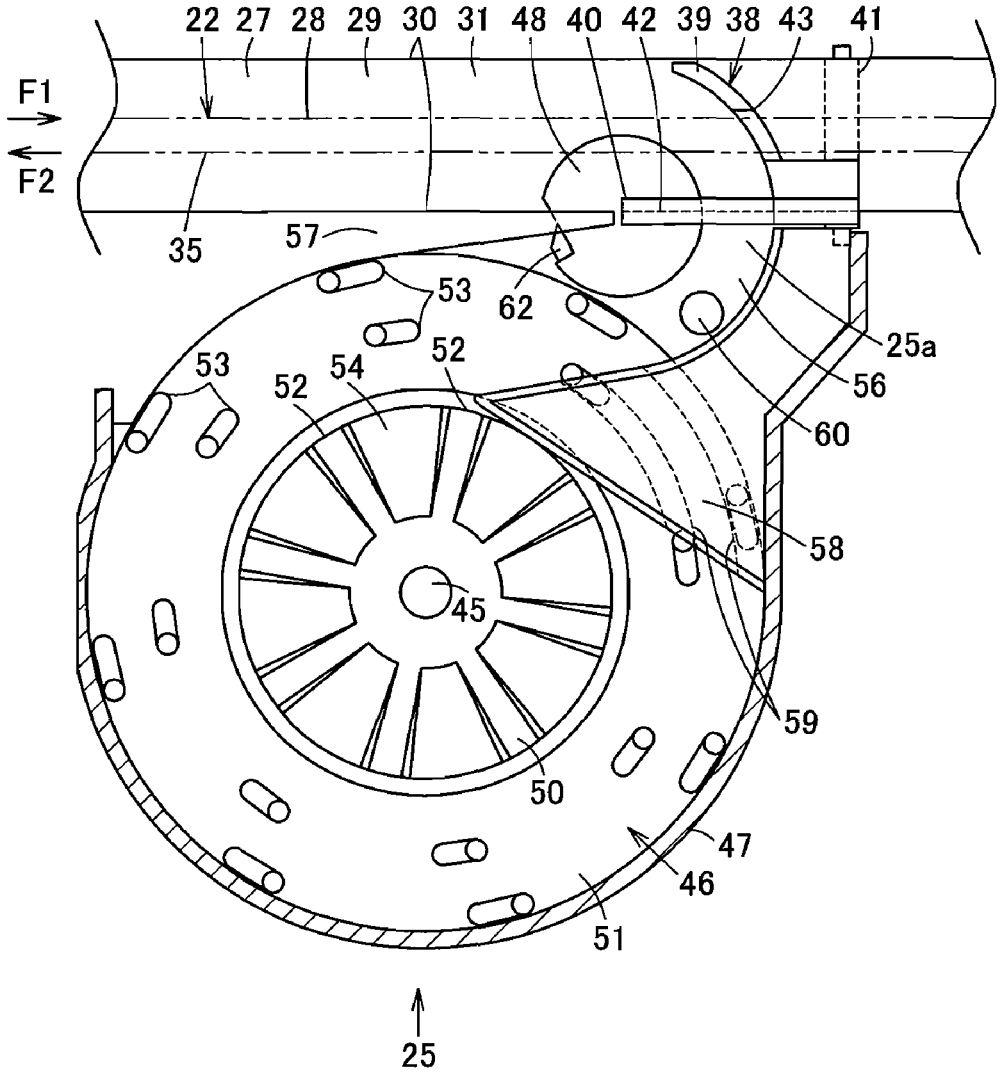
[FIG. 3] is a front view of an accommodating and ejecting unit of the same coin depositing and dispensing machine.

FIG. 3 shows the sorting member 38 for a single accommodating and ejecting unit 25. The sorting member 38 has, in an integral manner, a coin guiding portion 39, guiding a coin to the coin outlet/inlet 25*a*, a closing portion 40, preventing the entry of a coin into the coin outlet/inlet 25*a*, and a supporting portion 41, swingably supporting the coin guiding portion 39 and the closing portion 40.

The coin guiding portion 39 is disposed so that one side, which is a lower side in a width direction intersecting the passage direction of the coin passage 27 and is the side at which the coin outlet/inlet 25*a* side is disposed, is tilted with respect to the other side, which is an upper side in the width direction of the coin passage 27 and is disposed opposite the coin outlet/inlet 25*a*, at a predetermined angle toward the downstream side in the conveying direction when the conveying means 22 is driven in the depositing and conveying direction F1, and is formed to a concavely curved face facing the upstream side in the conveying direction when the conveying means 22 is driven in the depositing and conveying direction F1.

The closing portion 40 is provided with a guide face 42 that is flush with the lower guiding side plate 30 and guides the circumference of a coin.

The supporting portion 41 is disposed at the downstream side in the depositing and conveying direction F1 with respect to the coin guiding portion 39, and the closing portion 40 is rotatable about an axis in the width direction of the coin passage 27 as a supporting point and is driven to rotate by a solenoid or other electrical driving means. When a coin is to be sorted from the coin passage 27 to the accommodating and ejecting unit 25 or when a coin is to be fed from the accommodating and ejecting unit 25 to the coin passage 27, the sorting member 38 is disposed at a coin output/input position at which the coin guiding portion 39 projects from the passage face 29 of the coin passage 27 and the closing portion 40 is put in a state of opening the coin outlet/inlet 25*a*. On the other hand, when a coin is not to be sorted from the coin passage 27 to the accommodating and ejecting unit 25 or when a coin is not to be fed from the accommodating and ejecting unit 25 to the coin passage 27, the sorting member 38 is disposed at a coin passing position at which the coin guiding portion 39 is retracted in the passage face 29 of the coin passage 27 and the closing portion 40 is put in a state of closing the coin outlet/inlet 25*a*. An opening, through which the coin guiding portion 39 projects and retracts, is formed in the passage face 29 of the coin passage 27. A groove portion 43, for avoiding interference with the belt 35 when the coin guiding portion 39 of the sorting member 38 projects from the coin passage 27, is formed in the coin guiding portion 39.

The sorting member 38 for the pooling and feeding unit 24 has the same coin guiding portion 39, closing portion 40, and supporting portion 41 as the sorting member 38 for the accommodating and ejecting unit 25 and is driven by an electrical driving means.

The pooling and feeding unit 24 and the respective accommodating and ejecting units 25 differ only in direction, etc. and are formed to be the same in the basic arrangement of outputting and inputting coins one by one to and from the conveying means 22.

The single accommodating and ejecting unit 25 in FIG. 3 shall now be described. The accommodating and ejecting unit 25 includes a rotating disk 46, disposed at a position at which its upper portion is tilted in a rear face direction at a predetermined angle with respect to a horizontal direction (see FIG. 2) and enabled to rotate about a rotational axis 45, a hopper 47, pooling coins between itself and a top face side of the rotating disk 46, and a delivery circular plate 48, disposed near the coin outlet/inlet 25*a*.

The rotating disk 46 is rotatably disposed so that the top face of the rotating disk 46 is flush with the top face of the base 21. The rotating disk 46 is driven to rotate by a motor in a feeding rotation direction (clockwise direction in FIG. 3) of feeding coins to the coin passage 27 in conjunction with the belt 35 and the delivery circular plate 48. The rotating disk 46 may also be enabled to be driven to rotate in a counter-feeding rotation direction that is reverse the feeding rotation direction in order to resolve jamming of coins when jamming of coins occurs.

A circular high portion 50 is formed at a central region of the top face of the rotating disk 46, and an annular low portion 51 is formed at an outer circumferential region of the high portion 50. Between the high portion 50 and the low portion 51 of the rotation disk 46 are formed step-like coin circumference retaining portions 52, each of which has a dimension slightly less than a minimum coin thickness of the coins processed and on which a circumference of a single coin can be placed in the thickness direction.

In the low portion 51, a plurality of picking-up members 53, projecting from the top face of the rotating disk 46, are disposed at a predetermined pitch in two rows in circumferential directions, that is, in a circumferential direction row at an inner circumferential side and in circumferential direction row at an outer circumferential side. The respective picking-up members 53 at the outer circumferential side are disposed at upstream sides in the feeding rotation direction of the rotating disk 46 with respect to the respective picking-up members 53 disposed at the inner circumferential side. The picking-up members 53 are constituted so that during rotation of the rotating disk 46 in the feeding rotation, each picking-up member 53 at the inner circumferential side retains a coin singly between itself and the coin circumference retaining portion 52 and picks up the coin to an upper region of the rotating disk 46, and each picking-up member 53 at the outer circumferential side pushes the coin, picked up to the upper region of the rotating disk 46 by the corresponding inner circumferential picking-up member 53, out toward the coin outlet/inlet 25*a* and delivers the coin to the delivery circular plate 48.

The coin circumference retaining portions 52 are disposed at respective positions at which coins can be retained one by one between the coin circumference retaining portions 52 and the picking-up member 53. The plurality of coin circumference retaining portions 52 are thus disposed in the circumferential direction. Between the coin circumference retaining portions 52 are formed sliding portions 54, with each of which a step between the high portion 50 and the low portion 51 is formed to a tilting face that makes a coin, which is not retained by the picking-up member 53 and the coin circumference retaining portion 52, slide downward.

At the upper region of the rotating disk 46 is formed a guide passage 56 that feeds coins, picked up to the upper region of the rotating disk 46 by the picking-up members 53, toward the coin outlet/inlet 25*a*. The guide passage 56 is formed between a top face of the rotating disk 46, the passage face 29, which is a top face in common to the base 21 and the coin passage 27, and guide members 57 and 58 at upper and lower sides, respectively.

The upper guide member 57 is formed to project above the top faces of the rotating disk 46 and the passage face 29 from the upper region of the rotating disk 46 to one edge side of the coin outlet/inlet 25*a*.

The lower guide member 58 is disposed from the coin circumference retaining portion 52 side to the other edge side of the coin outlet/inlet 25*a* in a state of opposing a top face of the lower portion 51 across a gap into which a coin cannot enter. An inner edge of the guide member 58 that faces an interior of the guide passage 56 is formed to a curved face continuing to the coin guiding portion 39 of the sorting member 38. Groove portions 59, through which the respective, rotationally-moving picking-up members 53 pass, are formed on a face of the guide member 58 that opposes the lower portion 51. The guide member 58 is constituted to receive coins, picked up by the picking-up members 53, from the coin circumference retaining portion 52 and guide the coins to the coin outlet/inlet 25*a*.

At the guide passage 56, a projecting portion 60, enabled to be projected from and retracted into the passage face 29, is disposed near the lower guide member 58. The projecting portion 60 is, for example, electrically driven by a solenoid, etc., and is retracted in the passage face 29 when the closing portion 40 of the sorting member 38 is in an open state and is projected from the passage face 29 and makes a coin in the guide passage 56 fall into the hopper 47 when the closing portion 40 is at a closed position.

In addition, the hopper 47 is mounted onto the top face side of the base 21 and is formed to a shape that is open at an upper side (see FIG. 2).

Figure 4:
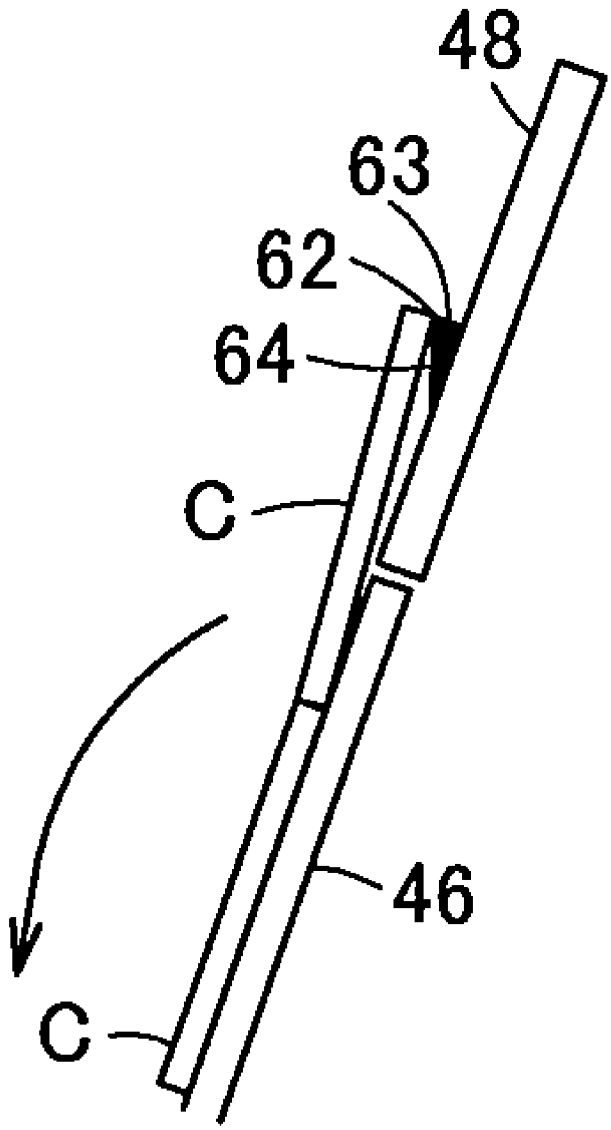
[FIG. 4] is a sectional view of a projection of a delivery circular plate of the accommodating and ejecting unit.

In addition, the delivery circular plate 48 is rotatably disposed at a position at which it spans across the guide passage 56 and the coin passage 27 in a manner such that a top face of the delivery circular plate 48 is flush with the rotating disk 46 and the passage face 29 at the top face of the base 21. A projection 62, which contacts and feeds a coin from the rotating disk 46 side to the coin passage 27 is projected at an outer circumferential portion of the delivery circular plate 48. The delivery circular plate 48 rotates in conjunction with the belt 35 and, when the belt 35 moves in the dispensing and conveying direction F2, rotates in a feeding rotation direction in which the projection 62 moves from the coin outlet/inlet 25*a* into the coin passage 27, that is, a feeding rotation direction (counterclockwise direction in FIG. 3) in which a coin is fed by the projection 62 from the rotating disk 46 side to the coin passage 27 and, when the belt 35 moves in the depositing and conveying direction F1, rotates in a counter-feeding rotation direction (clockwise direction in FIG. 3) in which the projection 62 moves from the coin passage 27 into the interior of the coin outlet/inlet 25*a*. As shown in FIG. 4, the projection 62 has a latching face 63, which is substantially perpendicular to the top face of the delivery circular plate 48 and engages with a circumference of a coin, formed on a face opposing the feeding rotation direction of the rotating disk 46, and has a tilted face 64, onto which a coin rides, formed on an opposite face. In addition, the accommodating and ejecting units 25 disposed in the second passage portion 33 differ from the accommodating and ejecting units 25 disposed in the first passage portion 31 only in direction corresponding to the coin conveying directions being opposite between the first passage portion 31 and the second passage portion 33, and these units are formed to be the same in basic shape. In addition, the pooling and feeding unit 24 differs from the accommodating and ejecting units 25 disposed in the first passage portion 31 only in being opposite in direction and is formed to have the same basic arrangement and, the delivery circular plate 48 rotates in the feeding rotation direction when the belt 35 moves in the depositing and conveying direction F1 and the delivery circular plate 48 rotates in the counter-feeding rotation direction when the belt 35 moves in the dispensing and conveying direction F2.

In addition, as shown in FIG. 1, an ejecting mechanism 66, ejecting coins, conveyed by the conveying means 22, to the coin ejection port 17, is disposed at the terminal end of the second passage portion 33. In addition, the ejecting mechanism 66 can sort coins using a sorting member having the same function as the sorting member 38. The ejecting mechanism 66 also functions as a rejection sorting mechanism that sorts a coin, which was not identified to be a normal coin by the identifying unit 23 in the depositing process, to the coin ejection port 17 to return the coin.

As shown in FIG. 2, in the reverting passage portion 34 is disposed a diverging mechanism 68, diverging overflowing coins, which cannot be accommodated due to the accommodating and ejecting units 25 being full of coins, from the coin passage 27. An accommodating box 69, accommodating coins diverged by the diverging mechanism 68, is detachably disposed inside the machine body 12.

Figure 5:
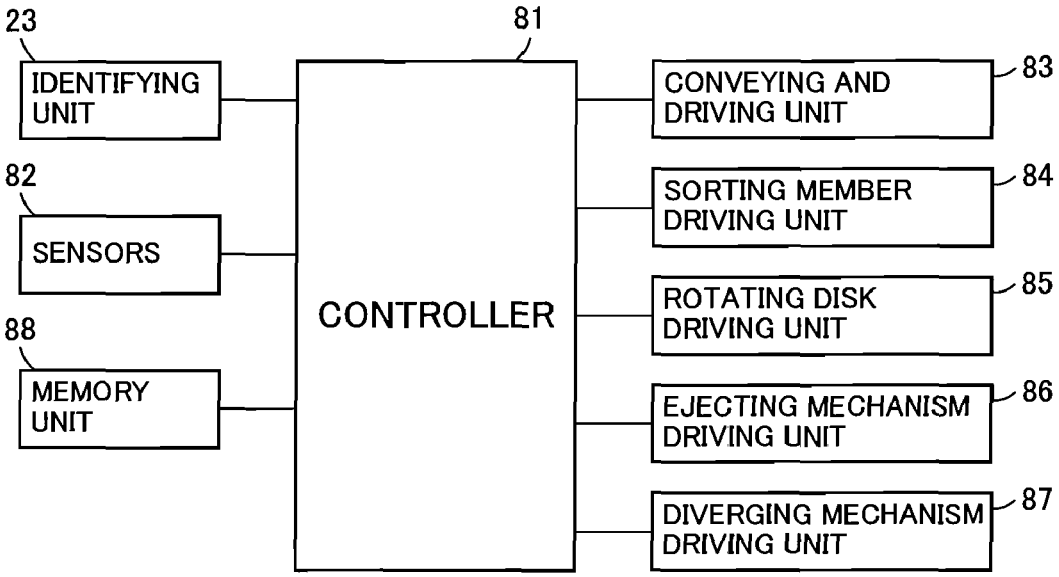
[FIG. 5] is a block diagram of the same coin depositing and dispensing machine.

In addition, FIG. 5 is a block diagram of a controller 81 that controls the coin depositing and dispensing machine 11.

The controller 81 receives input of signals from the identifying unit 23, which identifies the types of coins, the various sensors 82, disposed in the coin depositing and dispensing machine 11, etc., and controls a conveying and driving unit 83, using a motor, etc., to drive the belt 35 and the delivery circular plates 48, a sorting member driving unit 84, using solenoids, motors, etc., to drive the sorting members 38 of the pooling and feeding unit 24 and the respective accommodating and ejecting units 25, a rotating disk driving unit 85, using motors, etc., to drive the respective rotating disks 46, an ejecting mechanism driving unit 86, using a solenoid, motor, etc., to drive the ejecting mechanism 66, a diverging mechanism driving unit 87, using a solenoid, motor, etc., to drive the diverging mechanism 68, etc.

The sensors include a plurality of sensors, disposed along the coin passage 27 to detect positions of coins conveyed in the coin passage 27, sensors, respectively disposed at the guide passages 56 of the pooling and feeding unit 24 and the respective accommodating and ejecting units 25 to detect the outputting and inputting of coins with respect to the pooling and feeding unit 24 and the respective accommodating and ejecting units 25, etc.

The controller 81 has a memory unit 88, and the numbers of coins accommodated in the respective accommodating and ejecting units 25 are memorized in the memory unit 88.

The controller 81 has a function of making coins, conveyed by the conveying means 22, be sorted, in accordance with the identification results of the identifying unit 23, among the accommodating and ejecting units 25 of the respective denominations that have been set in advance, and a function of driving the conveying means 22 in the depositing and conveying direction F1 when coins are to be fed from the pooling and feeding unit 24 and accommodated in the accommodating and ejecting units 25 and driving the conveying means 22 in the dispensing and conveying direction F2 when coins are to be fed from the accommodating and ejecting units 25 and ejected to the coin ejection port 17.

In addition, the controller 81 also has a function of performing, with the pooling and feeding unit 24 and a single accommodating and ejecting unit 25, mutually between which coins can be moved by the conveying means 22 and through the identifying unit 23, a detailed check of the number of coins accommodated in the accommodating and ejecting unit 25 by making coins be fed one by one from the accommodating and ejecting unit 25, the fed coins be identified by the identifying unit 23 and memorized by the memory unit 88, the identified coins be accommodated in the pooling and feeding unit 24, and, after all of the coins in the accommodating and ejecting unit 25 have been moved to the pooling and feeding unit 24, all of the coins in the pooling and feeding unit 24 are fed one by one and accommodated back in the accommodating and ejecting unit 25.

Actions of the first embodiment shall now be described.

First, depositing and dispensing processes of the coin depositing and dispensing machine 11 shall be described in outline.

Figure 6:
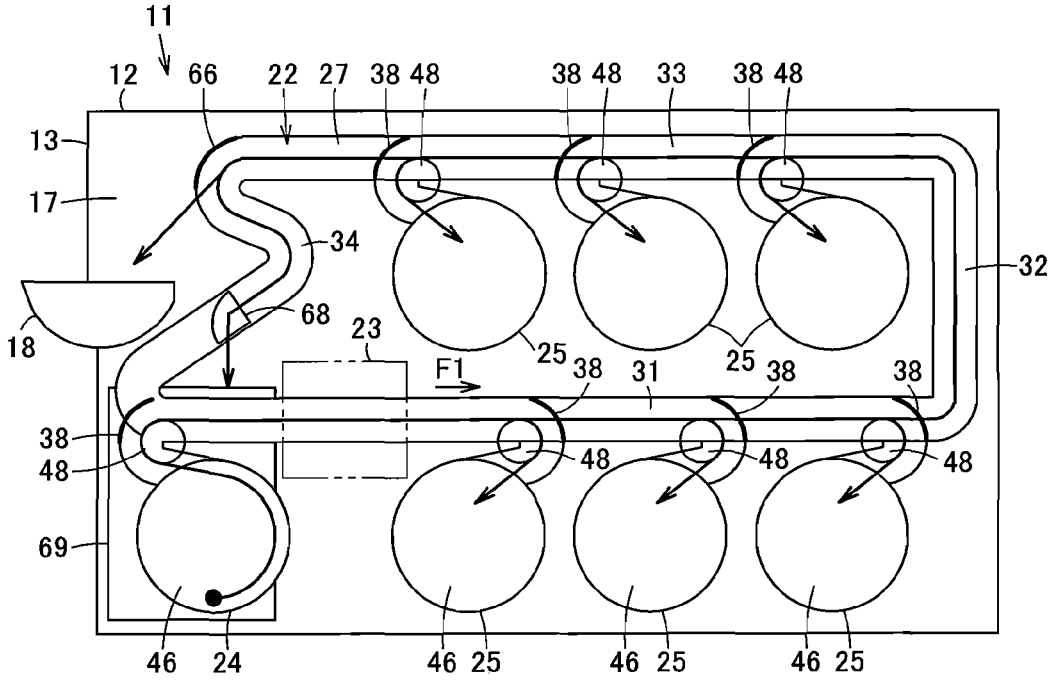
[FIG. 6] is an explanatory diagram of a depositing process of the same coin depositing and dispensing machine.

FIG. 6 shows the depositing process.

Deposited coins, input into the coin acceptance port 16 by a customer, etc., are accepted and pooled collectively at the pooling and feeding unit 24.

The belt 35 is driven in the depositing and conveying direction F1 and in conjunction with the belt 35, the delivery circular plate 48 of the pooling and feeding unit 24 is rotated in the feeding rotation direction and the delivery circular plates 48 of the respective accommodating and ejecting units 25 are rotated in the counter-feeding rotation direction.

The rotating disk 46 of the pooling and feeding unit 24 is rotated in the feeding rotation direction, coins are picked up one by one by the picking-up member 53 of the rotating disk 46 and delivered to the delivery circular plate 48, and by swinging the sorting member 38 to the coin outputting/inputting position in this process, coins are fed by the delivery circular plate 48 to the coin passage 27. Coins are thus separated one by one and fed intermittently from the pooling and feeding unit 24 to the coin passage 27.

The coins that are separated one by one and fed intermittently from the pooling and feeding unit 24 to the coin passage 27 enter between the plurality of projections 36 of the rotating belt 35 one by one and each coin is pushed by one side of the projection 36 at the upstream side in the conveying direction and thereby moved along the coin passage 27 in the depositing and conveying direction F1. The coins in the coin passage 27 are thus conveyed one by one separately and intermittently by the belt 35.

The types of the coins moving along the coin passage 27 in the depositing and conveying direction F1 are identified by the identifying unit 23.

A coin, which has been identified to be a normal coin as a result of identification by the identifying unit 23, is sorted, by the sorting member 38 of the accommodating and ejecting unit 25 that accommodates coins of the corresponding denomination, from the coin passage 27 to the coin outlet/inlet 25*a* of the accommodating and ejecting unit 25 and is accepted and accommodated in the accommodating and ejecting unit 25. When being accepted into the accommodating and ejecting unit 25, the coin is detected by a sensor and the memory unit 88 that memorizes the number of coins accommodated in the accommodating and ejecting unit 25 is made to update the number by incrementing the number by one.

A coin, which has not been identified to be a normal coin as a result of dentification by the identifying unit 23, is made to pass the positions of the respective accommodating and ejecting units 25 of the coin passage 27, conveyed to the terminal end of the second passage portion 33, sorted to the coin ejection port 17 by the ejecting mechanism 66, ejected on to the receptacle 18, and thereby returned.

When the number of coins accommodated in an accommodating and ejecting unit 25 for a certain denomination reaches a predetermined full number, coins of the corresponding type are thereafter conveyed as overflow coins to the reverting passage portion 34 of the coin passage 27, diverged from the coin passage 27 by the diverging mechanism 68, and accommodated in the accommodating box 69.

When accommodation of the deposited coins in the accommodating and ejecting units 25 or the accommodating box 69 is completed, the depositing process is ended. If after completion of accommodation of the deposited coins in the accommodating and ejecting units 25 or the accommodating box 69, approval of depositing by the customer, etc., is to be confirmed, the depositing process is ended at that point at which a depositing approval operation is performed by the customer, etc., or if a depositing disapproval operation is performed by the customer, etc., coins of amounts corresponding to the coins accommodated in the respective accommodating and ejecting units 25 or the accommodating box 69 are fed from the respective accommodating and ejecting units 25, ejected from the coin ejection port 17 to the receptacle 18, and thereby returned. This coin returning process is the same process as the dispensing process, which shall now be described.

Figure 7:
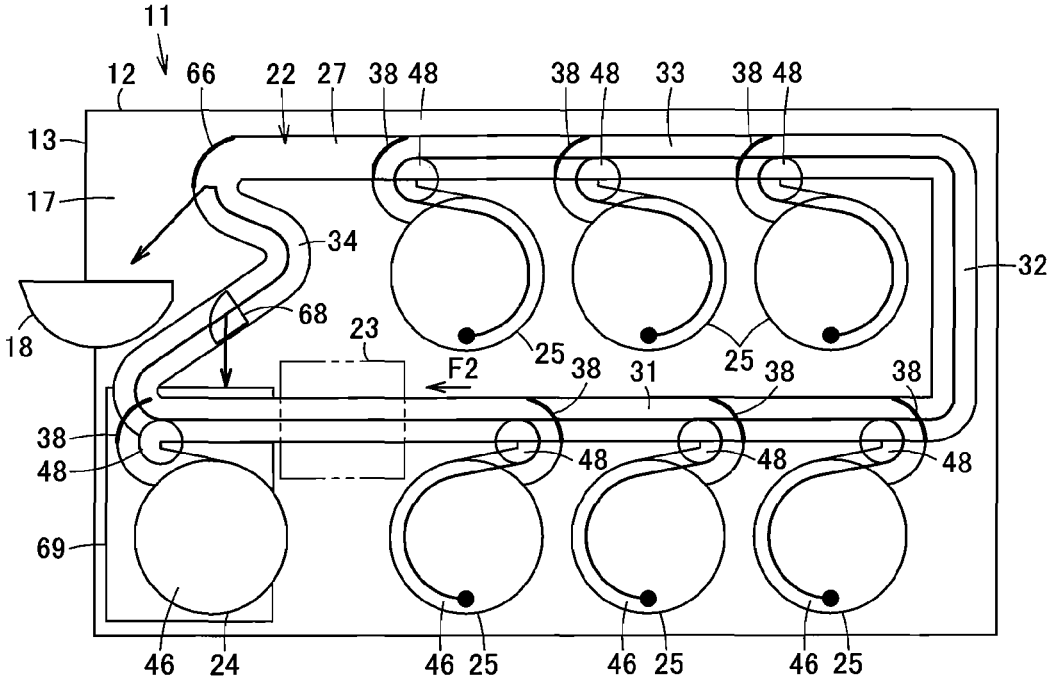
[FIG. 7] is an explanatory diagram of a dispensing process of the same coin depositing and dispensing machine.

FIG. 7 shows the dispensing process.

The belt 35 is driven in the dispensing and conveying direction F2, and in conjunction with the belt 35, the delivery circular plate 48 of the pooling and feeding unit 24 is rotated in the counter-feeding rotation direction and the delivery circular plates 48 of the respective accommodating and ejecting units 25 are rotated in the feeding rotation direction.

Coins of the denominations, determined from the dispensed amount instructed by the customer, etc., are fed sequentially one denomination at a time from the accommodating and ejecting units 25. At an accommodating and ejecting unit 25 accommodating coins of a corresponding denomination, the rotating disk 46 is rotated in the feeding rotation direction in conjunction with the belt 35 and the delivery circular plate 48, the coins are picked up one by one by the picking-up member 53 of the rotating disk 46 and delivered to the delivery circular plate 48, and by swinging the sorting member 38 to the coin outputting/inputting position at this time, coins are fed to the coin passage 27 by the delivery circular plate 48. Coins are thus fed one by one separately and intermittently from the accommodating and ejecting unit 25 to the coin passage 27. When being fed from the accommodating and ejecting unit 25, each coin is detected by the sensor and the memory unit 88 that memorizes the number of coins accommodated in the accommodating and ejecting unit 25 is made to update the number by decrementing the number by one.

The coins that are fed one by one separately and intermittently from the accommodating and ejecting unit 25 to the coin passage 27 enter between the plurality of projections 36 of the rotating belt 35 one by one and each coin is pushed by one side of the projection 36 at the upstream side in the conveying direction and thereby moved along the coin passage 27 in the dispensing and conveying direction F2. The coins in the coin passage 27 are thus conveyed one by one separately and intermittently by the belt 35.

The types of the coins moving along the coin passage 27 in the dispensing and conveying direction F2 are identified by the identifying unit 23.

A coin, which has been identified to be a normal coin as a result of dentification by the identifying unit 23, is conveyed to the terminal end of the second passage portion 33 through the reverting passage portion 34 of the coin passage 27, sorted to the coin ejection port 17 by the ejecting mechanism 66, ejected onto the receptacle 18, and thereby dispensed.

A coin, which has not been identified to be a normal coin as a result of: dentification by the identifying unit 23, is diverged from the coin passage 27 by the diverging mechanism 68 of the reverting passage portion 34 of the coin passage 27 and accommodated in the accommodating box 69. Coins of denominations that become insufficient are fed additionally from the accommodating and ejecting units 25.

When all dispensed coins have been ejected from the coin ejection port 17, the dispensing process is ended.

Because all of the passage portions 31 to 34 of the conveying means 22 are used in common in the coin depositing process and the coin dispensing process, the depositing and conveying path and the dispensing and conveying path are arranged as a common path.

Figure 8:
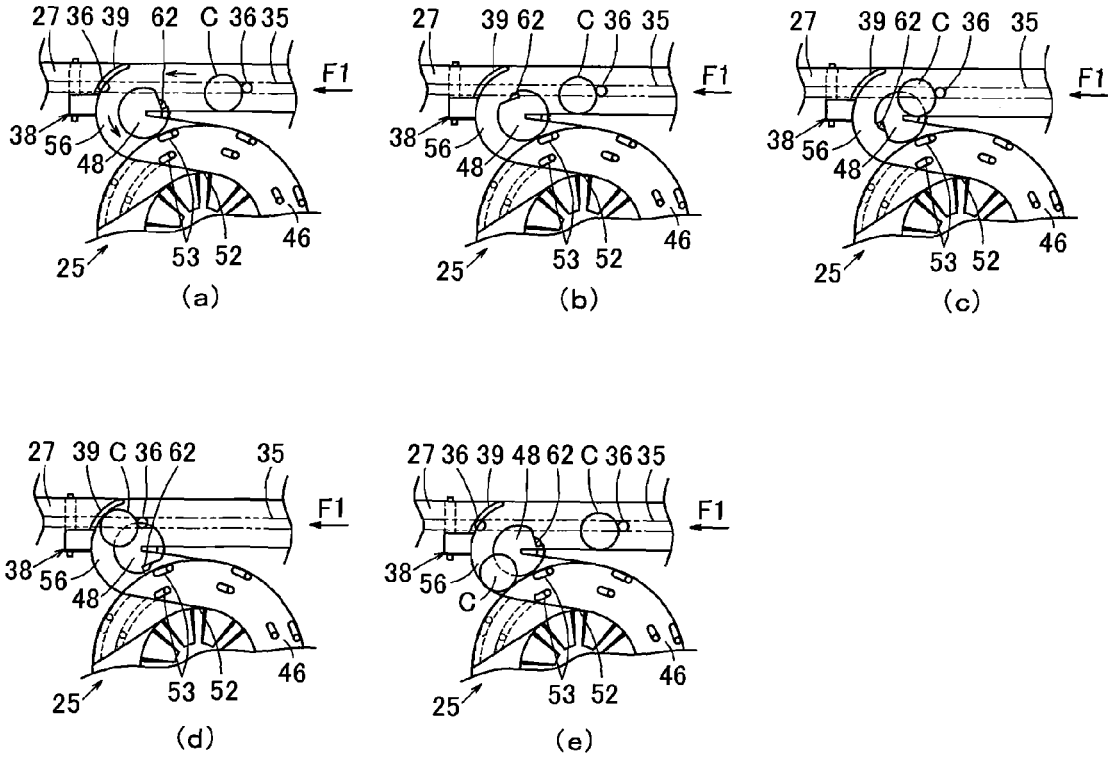
[FIGS. 8] (*a*) to (*e*) are explanatory diagrams of a depositing operation of the same accommodating and ejecting unit.

Next, with reference to FIG. 8, an operation of sorting and accommodating a coin (though indicated by the symbol C in the figure, this symbol shall be omitted hereinafter) in an accommodating and ejecting unit 25 in the depositing process shall be described. FIG. 8 shows the operation of sorting and accommodating a coin in the accommodating and ejecting unit 25 disposed in the second passage portion 33 of the coin passage 27.

In the depositing process, the belt 35 is driven in the depositing and conveying direction F1 and in conjunction with the belt 35, the delivery circular plate 48 of the accommodating and ejecting unit 25 is rotated in the counter-feeding rotation direction. The rotating disk 46 of the accommodating and ejecting unit 25 is not rotated.

As shown in FIGS. 8(*a*), 8(*b*), and 8(*c*), the coin is pushed by the projection 36 at the upstream side in the conveying direction of the rotating belt 35 and moved in the depositing and conveying direction F1. When a sensor at the coin passage 27 detects that the coin to be accommodated in the accommodating and ejecting unit 25 is conveyed, the sorting member 38 is swung to the coin outputting/inputting position, at which the coin guiding portion 39 projects from the passage face 29 of the coin passage 27 and the closing portion 40 puts the coin outlet/inlet 25*a* in the open condition.

By the coin reaching the position of the open coin outlet/inlet 25*a*, a support at the lower side of the coin is eliminated, thereby enabling the coin to enter the coin outlet/inlet 25*a*. In addition, by the coin that is pushed and moved by the projection 36 of the belt 35 coming into contact with the concavely curved coin guiding portion 39 of the sorting member 38 as shown in FIGS. 8(*d*) and 8(*e*), the coin is forcibly changed in direction and sorted toward the coin outlet/inlet 25*a* along the concavely curved coin guiding portion 39 and the sorted coin is accepted from the guide passage 56 into the accommodating and ejecting unit 25.

In this process, the projection 62 of the delivery circular plate 48 rotates at a position at which it does not obstruct the entry of the coin from the coin passage 27 into the coin outlet/inlet 25*a*.

Figure 9:
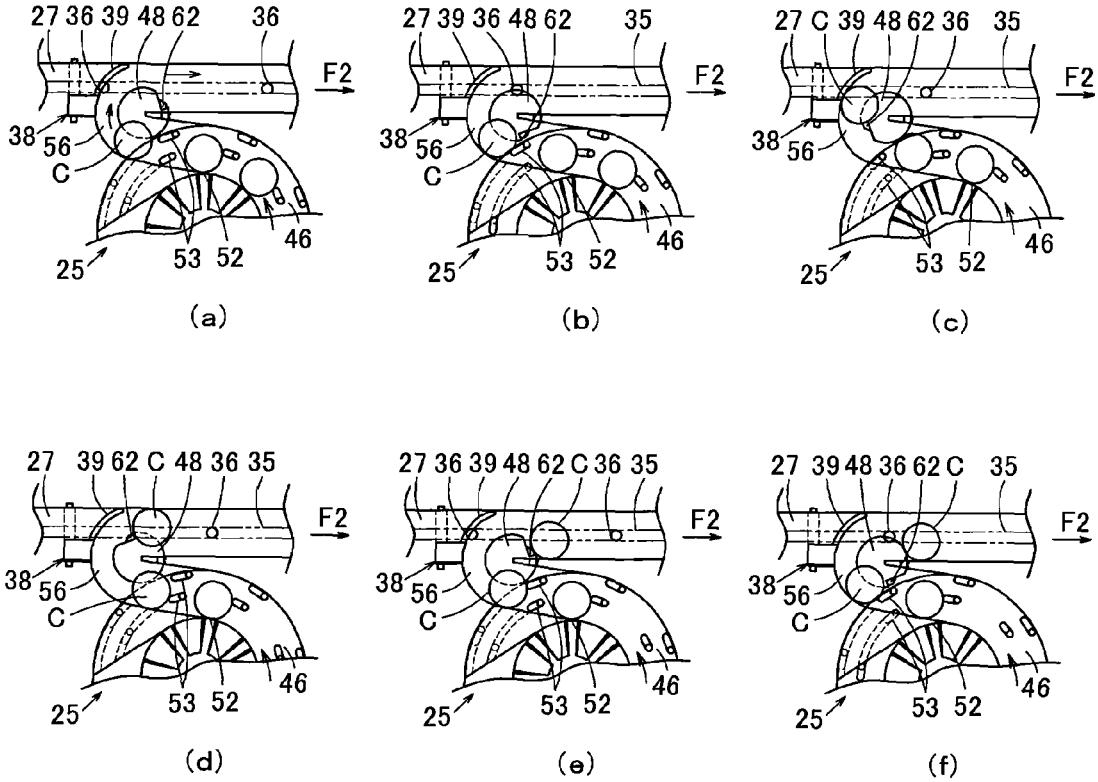
[FIGS. 9] (*a*) to (*f*) are explanatory diagrams of a dispensing operation of the same accommodating and ejecting unit.

Even when the amount of coins accommodated in the accommodating and ejecting unit 25 increases so that the coins accepted from the coin outlet/inlet 25*a* line up in the guide passage 56 and the coin accepted lastly stops near the coin outlet/inlet 25*a*, because the projection 62 of the delivery circular plate 48 rotates to the position of the stopped coin and the stopped coin rides up on the tilted face 64 of the projection 62 as shown in FIG. 4, the coin is forcibly lifted from the guide passage 56 and dropped into the hopper 47. The accommodation capacity of the coins that can actually be accommodated in the accommodating and ejecting unit 25 can thereby be increased. Next, with reference to FIG. 9, an operation of feeding a coin from an accommodating and ejecting unit 25 in the dispensing process shall be described. FIG. 9 shows the operation of sorting and accommodating a coin from the accommodating and ejecting unit 25 disposed in the second passage portion 33 of the coin passage 27.

In the dispensing process, the belt 35 is driven in the dispensing and conveying direction F2, and in conjunction with the belt 35, the delivery circular plate 48 of the accommodating and ejecting unit 25 is rotated in the feeding rotation direction. The rotating disk 46 of the accommodating and ejecting unit 25 is rotated in the feeding rotation direction in conjunction with the belt 35 and the delivery circular plate 48.

As shown in FIGS. 9(*a*) and 9(*b*), each picking-up member 53 at the inner circumferential side of the rotating disk 46 retains a coin singly between itself and the coin circumference retaining portion 52 and picks up the coin to the upper region of the rotating disk 46, and each picking-up member 53 at the outer circumferential side pushes the coin, picked up to the upper region of the rotating disk 46 by each inner circumferential picking-up member 53, out to the guide passage 56 and toward the coin outlet/inlet 25*a*.

In this process, the projection 62 of the delivery circular plate 48 rotates at a position at which it does not obstruct the entry of the coin from the rotating disk 46 into the guide passage 56.

As shown in FIG. 9(*b*), by the projection 62 of the delivery circular plate 48 rotating to the position of the coin, pushed out by the outer circumferential picking-up member 53 from the rotating disk 46 to the guide passage 56, the projection 62 of the delivery circular plate 48 receives the coin from the outer circumferential picking-up member 53 and pushes and feeds the coin toward the coin outlet/inlet 25*a*.

When the coin is detected by the sensor disposed at the guide passage 56, the sorting member 38 is swung to the coin outputting/inputting position, at which the coin guiding portion 39 projects from the passage face 29 of the coin passage 27 and the closing portion 40 puts the coin outlet/inlet 25*a* in the open condition.

As shown in FIGS. 9(*c*), 9(*d*), and 9(*e*), the coin that is fed by being pushed by the projection 62 of the delivery circular plate 48 enters the coin passage 27 from the coin outlet/inlet 25*a*, moves along the concavely curved coin guiding portion 39 of the sorting member 38, enters between projections 36 of the belt 35, guided to a side portion in the dispensing and conveying direction F2 of the coin outlet/inlet 25*a*, and transferred onto the lower guiding side plate 30 of the coin passage 27 from the projection 62 of the delivery circular plate 48.

As shown in FIG. 9(*f*), a projection 36 at the upstream side in the conveying direction of the belt 35 contacts the coin that is riding on the lower guiding side plate 30 of the coin passage 27 and conveys the coin in the dispensing and conveying direction F2.

Figure 10:
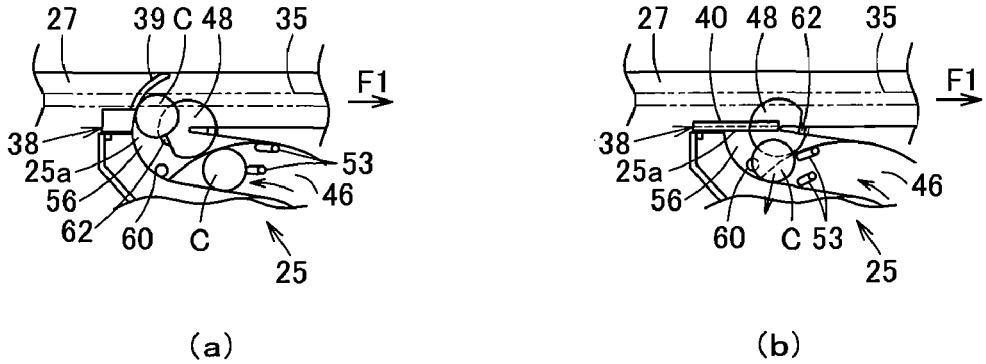
[FIGS. 10] (*a*) and (*b*) are explanatory diagrams of a dispensing halting operation of the same accommodating and ejecting unit.

Also as shown in FIG. 10(*a*), when the feeding of the required number of coins from the accommodating and ejecting unit 25 is detected by the sensor at the guide passage 56, the rotating disk 46 is stopped and at a timing at which the lastly fed coin enters the coin passage 27 completely, the sorting member 38 is swung to the coin passing position, at which the coin guiding portion 39 is retracted into the passage face 29 of the coin passage 27 and the closing portion 40 puts the coin outlet/inlet 25*a* in the closed state, as shown in FIG. 10(*b*).

Although even when the rotating disk 46 is stopped, it does not stop immediately and a subsequent coin is fed from the rotating disk 46 into the guide passage 56, by making the projecting portion 60 project from the passage face 29 of the guide passage 56 at the same time as swinging the sorting member 38 at the coin passing position, the subsequent coin fed from the rotating disk 46 into the guide passage 56 is made to drop into the hopper 47. Breakage of the sorting member 38 and jamming of coins due to the subsequent coin contacting the closing portion 40 of the sorting member 38 that closes the coin outlet/inlet 25*a* can thereby be prevented.

Figure 11:
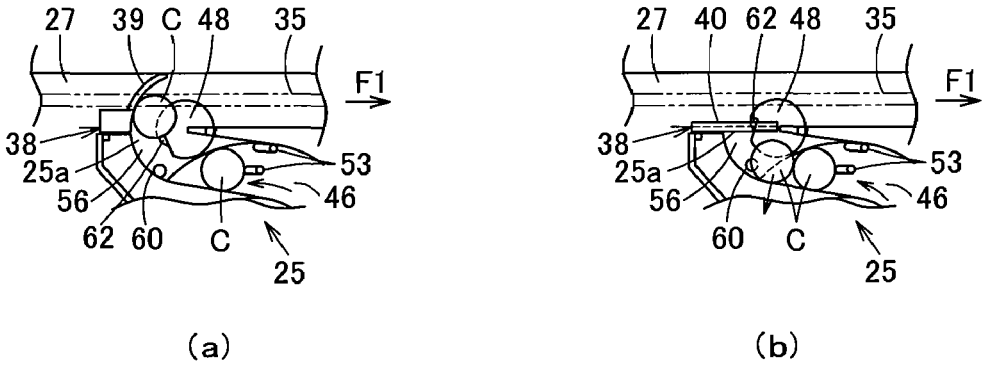
[FIGS. 11] (*a*) and (*b*) are explanatory diagrams of an operation of preventing feeding of two coins by the same accommodating and ejecting unit.

When during feeding of a coin to the coin passage 27 by the projection 62 of the delivery circular plate 48, the coin becomes detached from the projection 62 and drops into the guide passage 56 so that, along with a subsequent coin, two coins become lined up continuously as shown in FIGS. 11(*a*) and 11(*b*), by detection of the coin by the sensor at the guide passage 56 at this timing, it is judged that falling of the coin from the projection 62 has occurred and by the sorting member 38 then being swung to the coin passing position and the projecting portion 60 being projected from the passage face 29 of the guide passage 56, the two continuously aligned coins in the guide passage 56 are dropped into the hopper 47. The feeding of the two coins together can thereby be prevented.

In addition, although the operation of the accommodating and ejecting unit 25 is described here, an operation of sorting and accommodating coins into the pooling and feeding unit 24 and an operation of feeding coins from the pooling and feeding unit 24 are carried out in the same manner as the corresponding operations at the accommodating and ejecting unit 25.

Because with the coin depositing and dispensing machine 11, coins can be input and output from and to the conveying means 22 through the same coin outlet/inlet 25*a* of the accommodating and ejecting unit 25, the depositing and conveying path and the dispensing and conveying path of the conveying means 22 can be arranged as a common path and a more compact coin depositing and dispensing machine 11 can be provided.

Also, because in each accommodating and ejecting unit 25, the coins are accommodated in a non-aligned manner, the coins are not erected, etc., and accommodated improperly as in a case where the coins are stackingly accommodated in a cylinder, and the accommodation and ejection of the coins can be performed reliably. Furthermore, the pooling and feeding unit 24 and the accommodating and ejecting unit 25 can be made to have a basic arrangement in common.

Because the conveying means 22 is provided with a layout including the first passage portion 31, disposed from the front side toward the rear side of the machine body 12, the return passage portion 32, returning from the terminal end of the first passage portion 31 toward the front side of the machine body 12, and the second passage portion 33, disposed from the terminal end of the return passage portion 32 toward the front side of the machine body 12 and having the terminal end facing the coin ejection port 17, and the identifying unit 23 and the plurality of accommodating and ejecting units 25 are disposed in the first passage portion 31 sequentially along the conveying direction when the conveying means 22 is driven in the depositing and conveying direction F1, the coin depositing and dispensing machine 11 can be downsized. In particular, by the accommodating and ejecting units 25 being disposed allocatedly between the first passage portion 31 and the second passage portion 33, the dimension of the machine body 12 in the front/rear direction can be made short.

In addition, in the pooling and feeding unit 24 and one of the accommodating and ejecting units 25, mutually between which coins can be moved by the conveying means 22 and through the identifying unit 23, by feeding out coins one by one from the accommodating and ejecting unit 25, making the fed coins be identified by the identifying unit 23 and memorized by the memory unit 88, accommodating the identified coins in the pooling and feeding unit 24, and, after all of the coins in the accommodating and ejecting unit 25 have been moved to the pooling and feeding unit 24, feeding out all of the coins in the pooling and feeding unit 24 one by one and accommodating the coins back in the same accommodating and ejecting unit 25, the number of coins accommodated in the accommodating and ejecting unit 25 can be subject to a detailed check.

Figure 12:
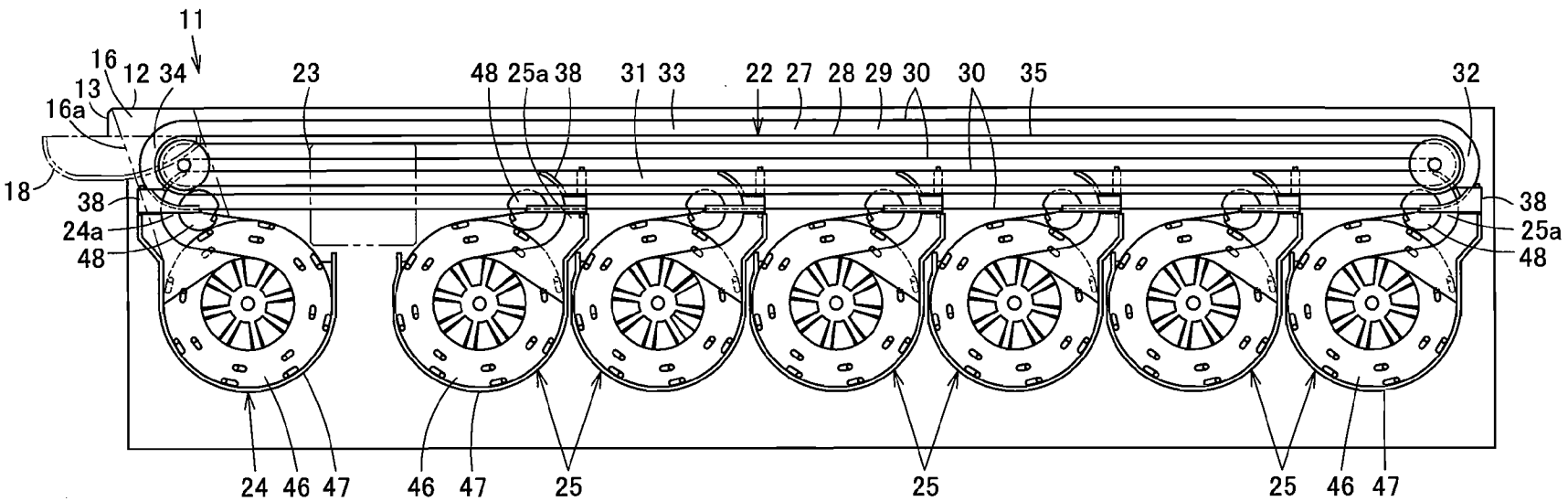
[FIG. 12] is a side view of an internal structure of a coin depositing and dispensing machine according to a second embodiment of the present invention.

A second embodiment is shown in FIG. 12.

In this embodiment, a plurality of accommodating and ejecting units 25 are disposed only along the first passage portion 31 of the conveying means 22. With this coin depositing and dispensing machine 11, although the length in the front/rear direction becomes longer in comparison to the coin depositing and dispensing machine 11 of the first embodiment, the height in the vertical direction is made low and this embodiment is thus suitable for a machine that is required to be low in height.

Figure 13:
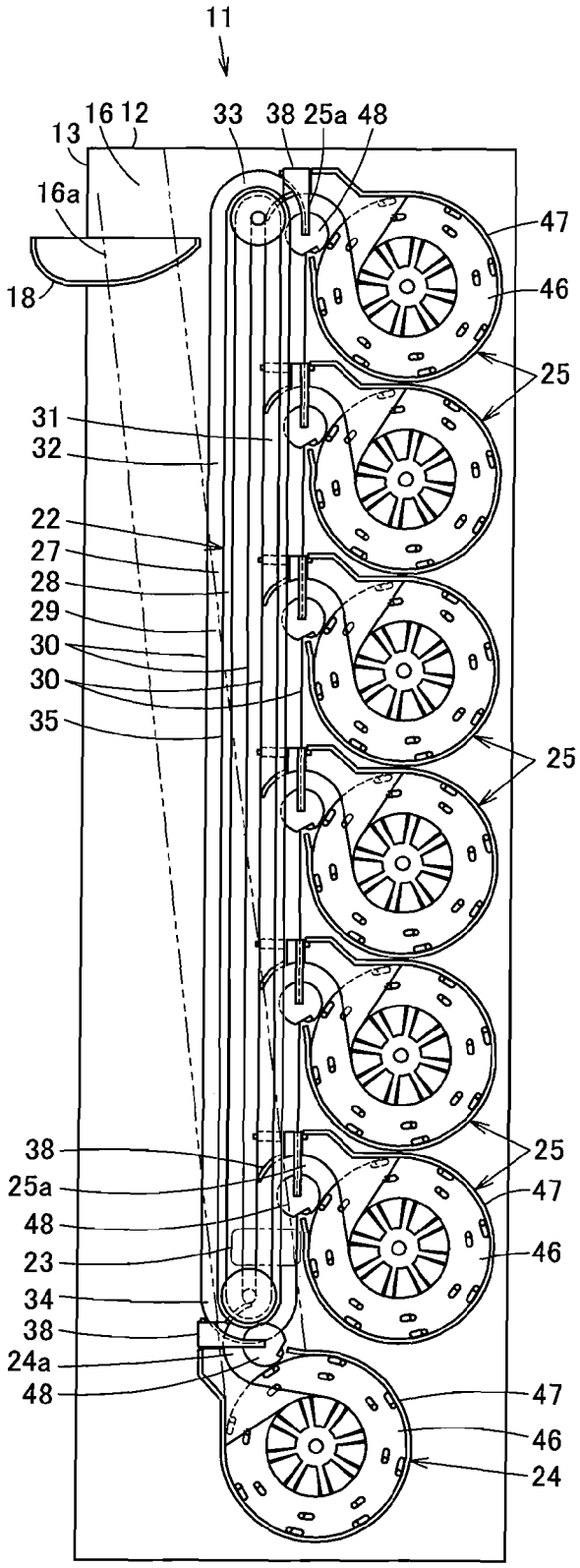
[FIG. 13] is a side view of an internal structure of a coin depositing and dispensing machine according to a third embodiment of the present invention.

A third embodiment is shown in FIG. 13.

In the present embodiment, the passage directions of the first passage portion 31 and the second passage portion 33 of the conveying means 22 are set to vertical directions, and the pooling and feeding unit 24, the identifying unit 23, and the plurality of accommodating and ejecting units 25 are disposed from the lower side of the first passage portion 31. With this coin depositing and dispensing machine 11, although the height in the vertical direction becomes higher in comparison to the coin depositing and dispensing machine 11 of the first embodiment, the depth in the front/rear direction can be made short and this embodiment is thus suitable for a machine that is required to be short in the depth dimension.

In addition, each of the respective embodiments described above may have a temporary storage unit temporarily storing coins and enabled to output and input coins to and from the conveying means 22. By providing the temporary storage unit, coins, which, among the coins accepted in the coin acceptance port 16 from outside the machine body 12, are identified to be normal coins, can be stored temporarily in the temporary storage unit until approval and confirmation of depositing, and after the approval and confirmation of depositing, the coins temporarily stored in the temporary storage unit may be fed and accommodated in the accommodation and depositing units 25 if depositing is approved, or be returned from the coin ejection port 17 if depositing is not approved. The temporary storage unit may be the same as the pooling and feeding unit 24 and the accommodating and ejecting unit 25 in basic arrangement and is enabled to output and input coins to and from the coin passage 27. As the temporary storage unit, a dedicated temporary storage unit may be disposed or one of the accommodating and ejecting units 25 may be used as the temporary storage unit. When coins accommodated in the temporary storage unit are to be accommodated in the accommodating and ejecting units 25, for example, the coins fed to the coin passage 27 from the temporary storage unit are accommodated in the pooling and feeding unit, and when all the coins in the temporary storage unit have been accommodated in the pooling and feeding unit, the coins are fed from the pooling and feeding unit and accommodated in the respective accommodating and ejecting units 25.

A fourth embodiment is shown in FIGS. 14 to 17.

Figure 14:
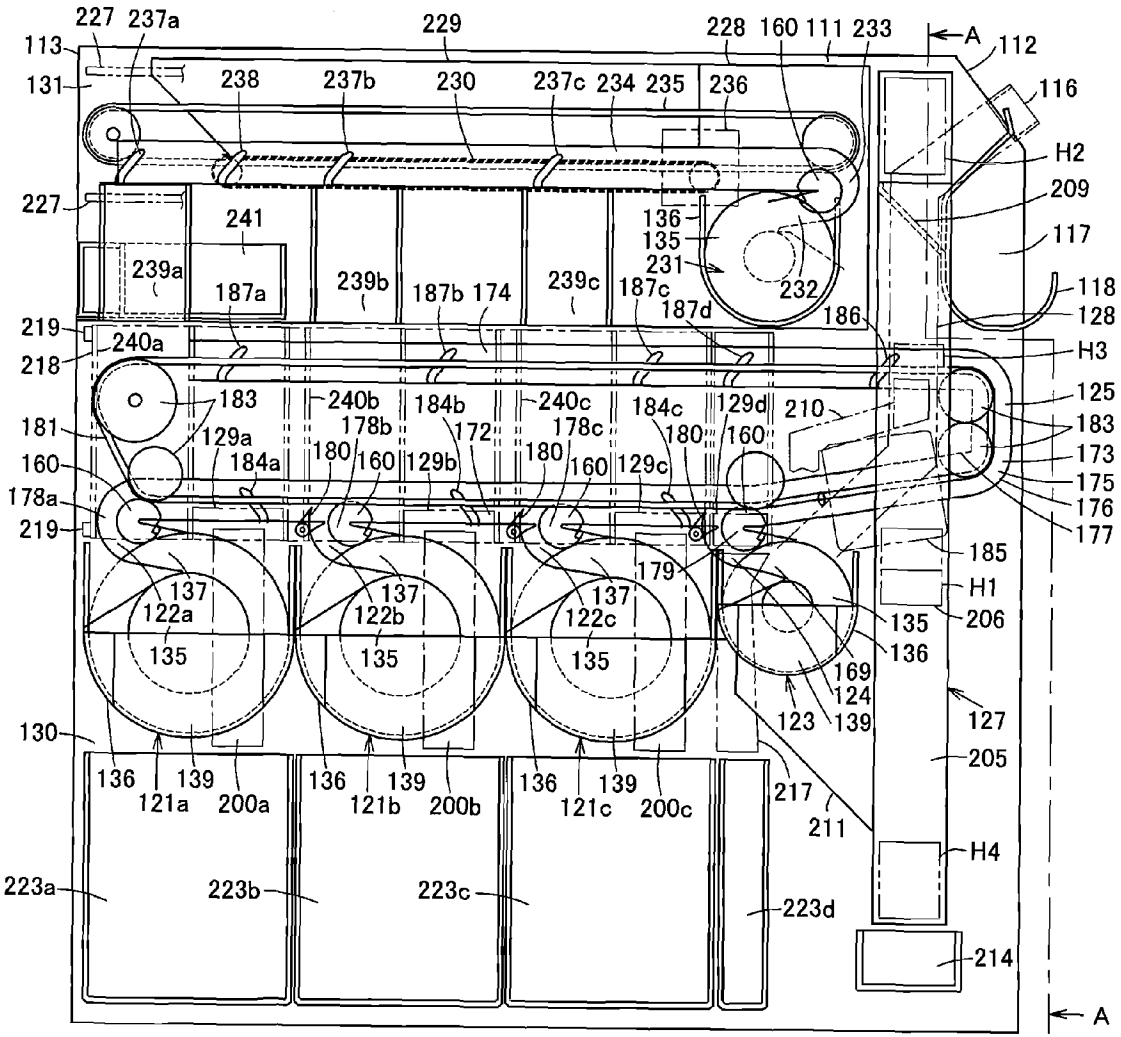
[FIG. 14] is a side view of an internal structure of a coin depositing and dispensing machine according to a fourth embodiment of the present invention.
Figure 15:
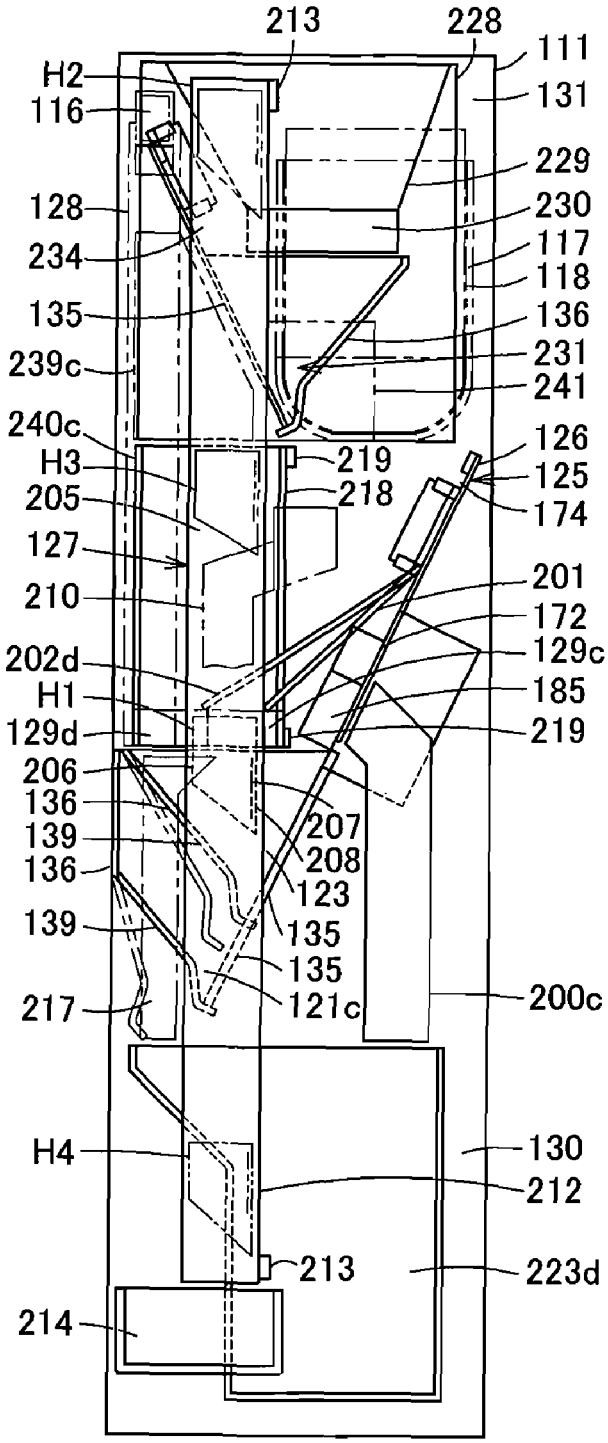
[FIG. 15] is a front view taken on line A-A of FIG. 14 of the same coin depositing and dispensing machine.

As shown in FIGS. 14 and 15, a coin depositing and dispensing machine has a machine body 111, a front face side (right side in FIG. 14, front face in FIG. 15) of the machine body 111 is arranged as a customer operation surface 112, by which a customer performs operations of input of deposited coins and take-out of dispensed coins, and a rear face side (left side in FIG. 1, face opposite that shown in FIG. 2) is arranged as a clerk operation surface 113, by which a clerk performs operations of coin replenishment, recovery, etc.

At an upper region of the customer operation surface 112 of the machine body 111, a coin acceptance port 116, through which deposited coins are accepted, and a coin ejection port 117, serving as a coin dispensing port through which rejected deposited coins, returned deposited coins, and dispensed coins are sent out, are disposed alongside each other in a width direction of the front face. The coin acceptance port 116 enables collective input of a plurality of coins in a vertical orientation, in which coin faces are aligned parallel to a vertical direction. The coin ejection port 117 is formed by a coin ejection port frame 118 enabling a customer to insert his/her fingers to take out coins.

Inside the machine body 111, accommodating and ejecting units 121*a*, 121*b*, and 121*c*, respectively storing dispensed coins of three denominations, for example, of 500 yen, 10 yen, and 100 yen, according to denomination in non-aligned states and feeding the coins one by one, are aligned along the front/rear direction, and dispensed coin leading passages 122*a*, 122*b*, and 122*c* are disposed as guide passages that feed coins, fed from the accommodating and ejecting units 121*a*, 121*b*, and 121*c*, upwardly. Along with a region in front of the accommodating and ejecting units 121*a*, 121*b*, and 121*c*, a pooling and feeding unit 123, receiving, accommodating, and then feeding deposited coins one by one, is disposed and a deposited coin leading passage 124, feeding coins, fed from the pooling and feeding unit 123, upwardly, is disposed. At an upper region of the accommodating and ejecting units 121*a*, 121*b*, and 121*c* and the pooling and feeding unit 123 is disposed a coin passage 125, accepting and conveying dispensed coins, fed from the dispensed coin leading passages 122*a*, 122*b*, and 122*c*, and deposited coins, fed from the deposited coin leading passage 124, and sorting the coins according to type. The accommodating and ejecting units 121*a*, 121*b*, and 121*c*, the dispensed coin leading passages 122*a*, 122*b*, and 122*c*, the pooling and feeding unit 123, the deposited coin leading passage 124, and the coin passage 125 are disposed on a top face side of a base 126, disposed in a tilted orientation in which an upper portion is tilted toward a back face direction (right direction in the front view of FIG. 15).

At a front region of the machine body 111 are disposed a conveying unit 127, conveying coins in a vertical direction, that is, conveying dispensed coins, separated at the coin passage 125, to the coin ejection port 117, etc., and a deposited coin chute 128, guiding deposited coins, input into the coin acceptance port 116, to the pooling and feeding unit 123.

Denomination-specific temporary storage portions 129*a*, 129*b*, 129*c*, and 129*d*, respectively storing coins of four denominations, for example, of 500 yen, 10 yen, 100 yen, and 50 yen, according to denomination in non-aligned states, are disposed at regions above the accommodating and ejecting units 121*a*, 121*b*, and 121*c* so as to face the top face side of the coin passage 125 in the machine body 111.

Figure 16:
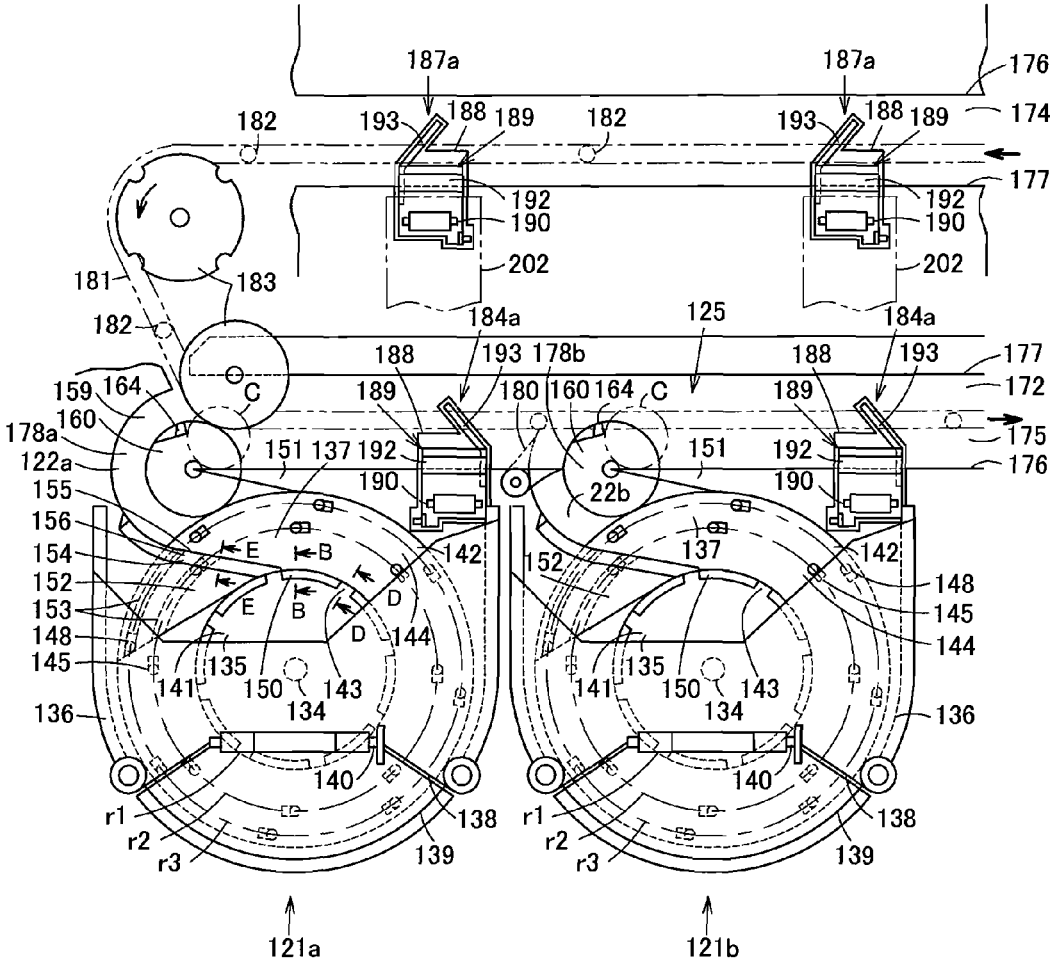
[FIG. 16] is a side view of an accommodating and ejecting unit and a portion of a coin passage of the same coin depositing and dispensing machine.

A recovering unit 130, recovering coins according to denomination, is disposed at a lower region in the machine body 111, and a replenishing unit 131, replenishing replenishment coins, is disposed at an upper region in the machine body 111. As shown in FIGS. 14 to 16, the accommodating and ejecting units 121*a*, 121*b*, and 121*c* have a structure in common and each includes a rotating disk 135, rotatable about a rotational axis 134, disposed at a rotational axis line, in a tilted orientation in which an upper portion is tilted in a back face direction (rear face direction), and a hopper 136, pooling coins (indicated in the figure by the symbol C, to be omitted hereinafter) between itself and a top face of the rotating disk 135. A dispensed coin feeding port 137, feeding out coins one by one in accordance with forward rotation of the rotating disk 135, is formed at an upper circumferential region of the rotating disk 135.

The rotating disk 135 is disposed in a circular opening formed in the base 126, is disposed so as to be flush with a top face side of the base 126, and is driven to rotate ina forward rotation direction (counterclockwise direction in FIGS. 14 and 16), which is a feeding rotation direction, and in a reverse rotation direction (clockwise direction in FIGS. 14 and 16). The hopper 136 is mounted on the top face side of the base 126.

A release port 138 is formed at least at a lower region of the hopper 136, and a movable hopper frame portion 139 that closes the release port 138 is disposed in a manner enabling opening and closing with a shaft 140 as a supporting point. When a foreign object that cannot be fed from the pooling and feeding unit 123 is detected by an unillustrated foreign detecting sensor, etc., the movable hopper portion 139 is opened to enable the foreign object to be released downward from the release port 138.

A circular high portion 141 is formed at a central region of the top face of the rotating disk 135, and a low portion 142, which is lower than the high portion 141 by just a dimension slightly less than the minimum coin thickness of the coins to be processed, is formed at an outer circumferential region of the high portion 141. Coin circumference retaining portions 143, on each of which a circumference of a coin can be placed in the thickness direction, are formed at step portions between the high portion 141 and the low portion 142 in a first predetermined radial region r1 from the rotational axis line of the rotating disk 135 (see FIG. 18(*b*)). A coin face retaining portion 144, which retains a back face of a coin and with which a dimension in a radial direction from the coin circumference retaining portions 143 is slightly greater than a maximum coin diameter of the coins to be processed, is formed at the lower portion 142.

Figure 17:
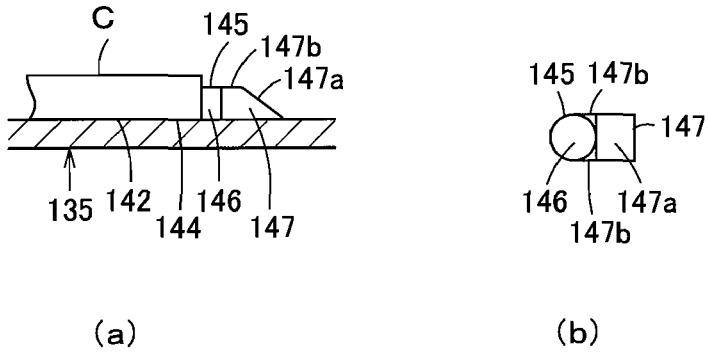
[FIG. 17] shows a picking-up member, provided on a rotating disk of the same coin depositing and dispensing machine, with (a) being a side view as viewed from a direction parallel to the rotating disk and (b) being a front view as viewed from a direction perpendicular to the rotating disk.

Within a second predetermined radial region r2 from the rotational axis line in the coin face retaining portion 144, a plurality of picking-up members 145, projecting to the top face side of the rotating disk 135, are fixedly disposed at a predetermined pitch in a circumferential direction. Each picking-up member 145 is enabled to retain, between itself and the coin circumference retaining portion 143, a single coin of any diameter from the maximum coin diameter to the minimum coin diameter of the coins processed and pick up the coin to an upper region of the rotating disk 135 during forward rotation of the rotating disk 135. As shown in FIG. 17, the picking-up member 145 has a metal pin 146, contacting a coin in opposition to the rotation direction during forward rotation of the rotating disk 135, and a guide portion 147, following the metal pin 146, and wear of the picking-up member 145 can be reduced by the metal pin 146. The guide portion 147 is formed of resin and is constituted of a guide part 147*a*, tilted from the coin face retaining portion 144 toward a leading end of the pin 146, and connecting parts 147*b*, connecting the guide part 147*a* with the pin 146, and during a process in which the rotating disk 135 is rotated in reverse, the guide portion 147 can prevent a coin from becoming caught by the pin 146 and thereby causing jamming of coins.

In a third predetermined radial region r3 at an outer side in the radial direction from the second predetermined radial region r2 in the coin face retaining portion 144, a plurality of picking-up members 148, projecting toward the top face side of the rotating disk 135 and serving in common as coin collapsing members, are fixedly disposed at a predetermined pitch in the circumferential direction. The plurality of picking-up members 148 are disposed in respective correspondence to the plurality of picking-up members 145 and are disposed at positions that are shifted rearward with respect to the forward rotation direction by a predetermined angle, centered at the rotational axis line, from the picking-up members 145. As with the picking-up members 145, each picking-up member 148 is constituted of the pin 146 and the guide portion 147.

Figure 18:
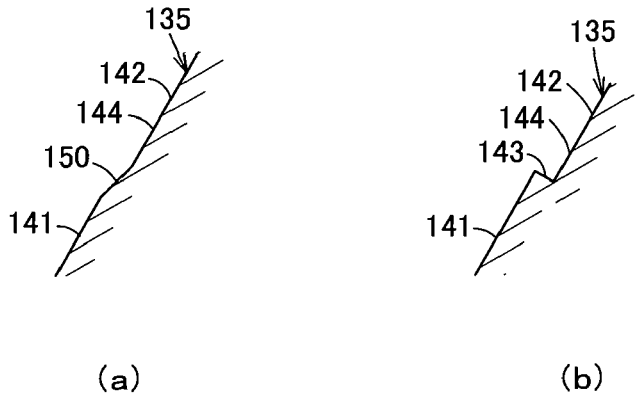
[FIG. 18] shows sectional views of a portion of the rotating disk of the same coin depositing and dispensing machine, with (a) being a sectional view taken on line B-B of FIG. 16 and (b) being a sectional view taken on line D-D of FIG. 16.

The coin circumference retaining portions 143 are formed at a predetermined pitch in a circumferential direction corresponding to the plurality of picking-up members 145 in the circumferential direction. The circumferential direction length of each coin circumference retaining portion 143 is set to a length by which a single coin is retained between the circumference retaining portion 143 and the corresponding picking-up member 145 during forward rotation of the rotating disk 135. As shown in FIGS. 16 and 18(*a*), between the plurality of coin circumference retaining portions 143 are formed sliding portions 150, with each of which the step portion between the high portion 141 and the low portion 142 is formed to a tilted face that makes a coin slide downward.

At an upper region of the rotating disk 135 are disposed upper and lower coin guide members 151 and 152 that constitute the dispensed coin feeding port 137 for feeding out coins to the outer side of the circumference of the rotating disk 135, that is, in a direction corresponding to the forward rotation direction of the rotating disk 135. The one coin guide member 151 at the upper side is disposed so as to project from the top face of the rotating disk 135 from an upper region of the rotating disk 135 to the dispensed coin feeding port 137.

The other coin guide member 152 at the lower side closely opposes the top face of the coin face retaining portion 144, is enabled to receive a coin in continuation from the coin circumference retaining portion 143, and guides the coin received from the coin circumference retaining portion 143 to the outer side of the circumference of the rotating disk 135. On a face of the coin guide member 152 opposing the coin face retaining portion 144 is formed a groove portion 153, through which the rotationally moving picking-up members 145 and picking-up members 148 pass.

Figure 19:
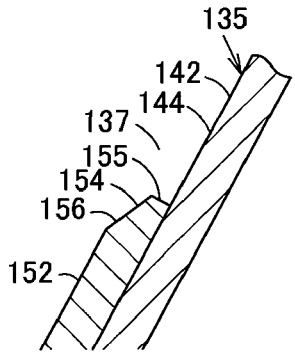
[FIG. 19] is a sectional view taken on line E-E of FIG. 16 of the rotating disk and a coin guide member of the same coin depositing and dispensing machine.

On the coin guide member 152 is formed a thickness-direction regulating guide portion 154 for making coins, which, among coins sent to the dispensed coin feeding port 137 in a state of being multi-layered in the thickness direction, are left and accumulated in a multi-layered manner unlike single-layered coins in contact with the coin face retaining portion 144, slide down into the hopper 136. As shown in FIG. 19, the thickness-direction regulating guide portion 154 is formed on the upper edge of the coin guide member 152, by forming a guide face 155, with a thickness direction dimension enabling placing of a single coin in contact with the coin face retaining portion 144, and forming a tilted face 156, which makes coins slide down, while leaving the guide face 155.

As shown in FIGS. 14 and 16, the respective dispensed coin leading passages 122*a*, 122*b*, and 122*c* have a structure in common and each is formed between the dispensed coin feeding port 137 and the coin passage 125 so as to change the direction and upwardly send coins, fed to the rear of the machine body 111 from the dispensed coin feeding port 137. Just the rearmost dispensed coin leading passage 122*a* is formed to a substantially U-like shape that changes the direction of coins, fed to the rear of the machine body 111 from the dispensed coin feeding port 137, by substantially 180° and feeds the coins toward the front. Each of the dispensed coin leading passages 122*a*, 122*b*, and 122*c* has a passage face 159 that is formed on the top face of the base 126, is flush with the coin face retaining portion 144 of the rotating disk 135, and guides the back faces of coins. At the inner circumferential side and outer circumferential side of the passage face 159 are respectively formed a coin guide member 151 and a coin guide member 152 that continue from the dispensed coin feeding port 137 and guide the circumferences of coins.

Each of the dispensed coin leading passages 122*a*, 122*b*, and 122*c* has disposed, between the dispensed coin feeding port 137 and a portion close to an entrance of the coin passage 125, a delivery circular plate 160 that contacts coins fed from the dispensed coin feeding port 137 and conveys the coins one by one separately to the coin passage 125. The delivery circular plate 160 is disposed rotatably at a circular opening formed in the base 126.

Figure 20:
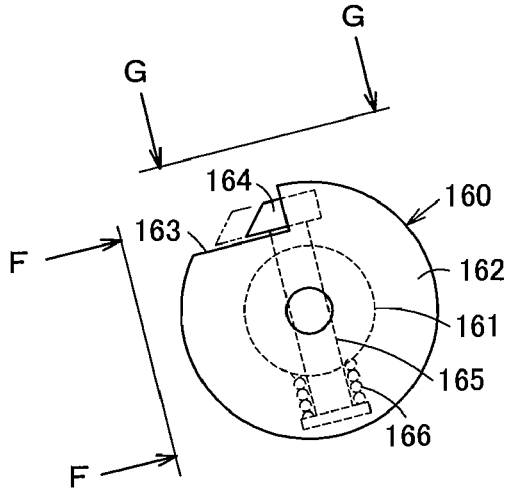
[FIG. 20] is a front view of a delivery circular plate of the same coin depositing and dispensing machine.
Figure 21:
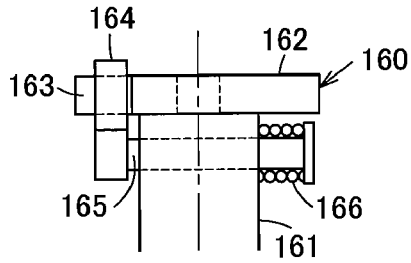
[FIG. 21] is a side view taken on line F-F of FIG. 20 of the delivery circular plate of the same coin depositing and dispensing machine.
Figure 22:
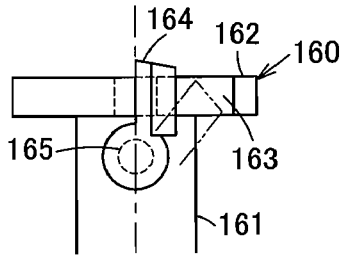
[FIG. 22] is a side view taken on line G-G of FIG. 20 of the delivery circular plate of the same coin depositing and dispensing machine.

As shown in FIGS. 20 to 22, the delivery circular plate 160 has a rotational face portion 162 that is substantially flush with the coin face retaining portion 144 of the rotating disk 135 and the passage face 159 and is rotatable about a rotational axis 161, disposed at a rotational axis line parallel to the rotational axis line of the rotating disk 135.

A notch 163 is formed at a circumferential portion of the rotational face portion 162, and at this notch 163 is disposed at least one projection 164 that contacts coins fed from the dispensed coin feeding port 137 and feeds the coins one by one separately toward the coin passage 125.

The projection 164 is supported pivotally by a shaft 165, passing through the rotational axis 161 orthogonally, so as to be able to swing according to the rotational direction of the delivery circular plate 160, is urged, in a direction of projecting from the rotational face portion 162, that is, toward a rotational direction of the delivery circular plate 160, by a spring 166 as an urging means mounted onto the shaft 165, and is thereby brought into contact with an edge of the notch 163 in a state of projecting substantially perpendicularly from the rotational face portion 162 and retained in the projected state. In the projected state, the projection 164 projects toward the top face side of the rotational face portion 162 by a dimension less than the minimum coin thickness of the processed coins. Next, as shown in FIGS. 14 and 15, the pooling and feeding unit 123, though being formed to be less in coin receiving and accommodation capacity and more compact than the accommodating and ejecting units 121*a*, 121*b*, and 121*c*, shares the same basic arrangement as the accommodating and ejecting units 121*a*, 121*b*, and 121*c*, and the same symbols shall be used and description thereof shall be omitted. In regard to the main arrangement, the pooling and feeding unit 123 has the rotating disk 135, which is put in a tilted orientation in which an upper portion is tilted toward a back face direction, is rotatable about a rotational axis line, and receives and accommodates deposited coins, the hopper 136, which pools deposited coins between itself and a top face of the rotating disk 135, etc. At a circumferential upper region of the rotating disk 135 is formed a deposited coin feeding port 169, from which deposited coins are fed one by one according to forward rotation of the rotating disk 135.

As shown in FIGS. 14 and 15, the deposited coin leading passage 124 shares the same basic arrangement as the respective dispensed coin leading passages 122*a*, 122*b*, and 122*c*, and the same symbols shall be used and description thereof shall be omitted. In regard to the main arrangement, the deposited coin leading passage 124 has the passage face 159, the delivery circular plate 160, having the projection 164, etc.

As shown in FIGS. 14 and 16, the coin passage 125 is formed to a substantially U-like shape having a first passage portion 172, disposed in a direction from a rear portion toward a front portion of the machine body 111 across upper regions of respective dispensed coin leading passages 122*a*, 122*b*, and 122*c* and the deposited coin leading passage 124, a return passage portion 173, directing the coin conveying direction upward from a front portion that is a terminal end of the first passage portion 172 and thereafter returning toward a portion above the first passage portion 172, and a second passage portion 174, conveying coins from an upper portion that is a terminal end of the return passage portion 173 toward the rear portion of the machine body 111 that is an upper region of the first passage portion 172.

These passage portions 172 to 174 have a passage face 175, formed on a top face of the base 126 and guiding back faces of coins in continuation to the respective dispensed coin leading passages 122*a*, 122*b*, and 122*c* and the deposited coin leading passage 124, and at respective sides in a passage width direction of the passage face 175 are disposed coin guide members 176 and 177 that guide circumferences of coins in continuation from the respective dispensed coin leading passages 122*a*, 122*b*, and 122*c* and the deposited coin leading passage 124.

At the first passage portion 172 are formed deposited coin introduction ports 178*a*, 178*b*, 178*c*, serving as coin outlets for accepting dispensed coins sent out from the respective dispensed coin leading passages 122*a*, 122*b*, and 122*c*, and a deposited coin introduction port 179, accepting deposited coins sent out from the deposited coin leading passage 124. The dispensed coin introduction ports 178*a*, 178*b*, and 178*c* are constituted as coin outlets for sending out coins to the coin passage 125 from the accommodating and ejecting units 121*a*, 121*b*, and 121*c* through the dispensed coin leading passages 122*a*, 122*b*, and 122*c*.

At respective edges at an upstream side in the conveying direction of the deposited coin introduction port 179 and the respective dispensed coin introduction ports 178*b* and 178*c*, besides the last dispensed coin introduction port 178*a*, are swingably pivoted restricting levers 180, allowing feeding of coins from the respective dispensed coin introduction ports 178*b* and 178*c* and the deposited coin introduction port 179 to the coin passage 125 and restricting coins, conveyed from a rear side that is the upstream side in the conveying direction of the first passage portion 172, from entering into the respective dispensed coin introduction ports 178*b* and 178*c* and the deposited coin introduction port 179. Each restricting lever 180 is disposed, by means of urging by a spring and by a stopper, at a horizontal orientation, indicated by a solid line, and when a coin rises upward from below, is swung upward (to a raised position indicated by an alternate long and short dash line) by the coin against the urging by the spring to enable the coin to be fed to the first passage portion 172.

Across the respective passage portions 172 to 174 is disposed a belt 181, serving as a conveying means, by which coins, fed one by one separately by the delivery circular plates 160, are conveyed one by one separately. On a face of the belt 181 opposing the passage face 175, a plurality of projections 182 are projected in a longitudinal direction of the belt 181 at a predetermined interval larger than the maximum diameter of the coins processed. The belt 181 is disposed to oppose the passage face 175 across a dimension greater than the maximum thickness of the coins processed, and the projections 182 are disposed to oppose the passage face 175 across a dimension less than the minimum thickness of the coins processed.

The belt 181 is tensioned in a rotatable manner across a plurality of pulleys 183, 183, 183, 183 and 183 respectively disposed rotatably at inner circumferential sides of a starting end portion of the first passage portion 172, a portion of the first passage portion 172 near the deposited coin introduction port 179, a last end portion of the first passage portion 172, and a starting end portion and a last end portion of the second passage portion 174, is rotated in conjunction with the rotation of the respective delivery circular plates 160 by being driven by a driving mechanism in common with the respective delivery circular plates 160, receives coins, fed one by one separately from the respective delivery circular plates 160, between the protrusions 182 in the longitudinal direction of the belt, and conveys the coins one by one separately by pushing each coin by the protrusion 182 disposed at a rear side in the conveying direction of the coin. A speed at which coins are conveyed by the respective delivery circular plates 160 and the belt 181 is set somewhat faster than a speed at which coins are fed by the respective rotating disks 135.

In the first passage portion 172, denomination-specific recovered coin separating units 184*a*, 184*b*, and 184*c*, respectively separating recovered 500-yen, 10-yen, and 100-yen coins according to denomination, are disposed sequentially along the conveying direction at stages subsequent in the conveying direction with respect to the deposited coin introduction ports 178*a*, 178*b*, and 178*c* for the respective denominations. An identifying unit 185, identifying coins, is disposed at a stage subsequent in the conveying direction with respect to the deposited coin introduction ports 178*a*, 178*b*, and 178*c* and the dispensed coin introduction port 179 of the first passage portion 172.

In the second passage portion 174, a dispensed coin separating unit 186, separating dispensed coins into dispensation suitable coins and dispensation non-suitable coins based on the identification results of the identifying unit 185 and separating rejected deposited coins, and denomination-specific separating units 187*d*, 187*c*, 187*b*, and 187*a*, respectively separating 50-yen, 100-yen, 10-yen, and 500-yen coins according to denomination, are disposed sequentially along the conveying direction.

The dispensed coin separating unit 186 and the denomination-specific separating units 187*d*, 187*c*, 187*b*, and 187*a* of the second passage portion 174 are all constituted to have the same structure, and the dispensed coin separating unit 186 and the denomination-specific separating units 187*d*, 187*c*, 187*b*, and 187*a* of the second passage portion 174 and the respective denomination-specific recovered coin separating units 184*a*, 184*b*, and 184*c* of the first passage portion 172 differ only in direction corresponding to the difference in the conveying directions at the second passage portion 174 and the first passage portion 172 and are basically constituted to have the same structure.

Figure 23:
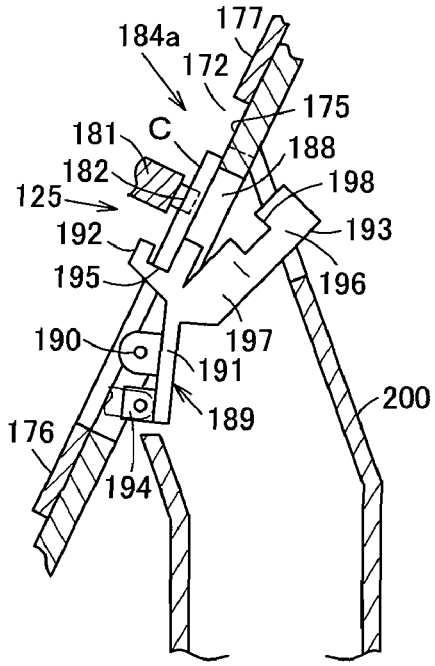
[FIG. 23] shows a denomination-specific recovered coin separating unit of a first passage portion of the coin passage of the same coin depositing and dispensing machine, with (a) being a sectional view during passage of a coin and (b) being a sectional view during diverging of a coin.
Figure 23:
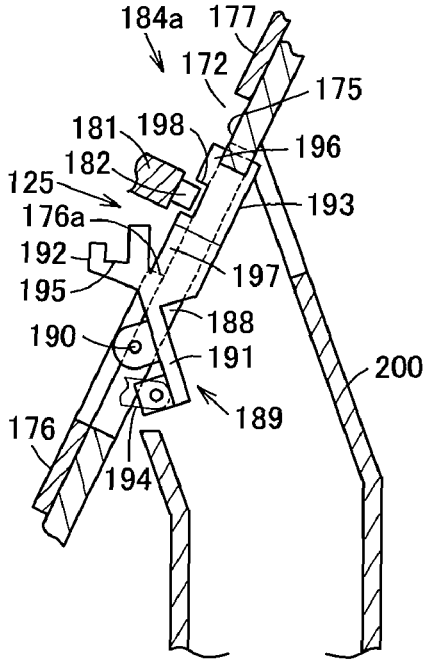

The denomination-specific recovered coin separating unit 184*a*, which is one of the denomination-specific recovered coin separating units 184*a*, 184*b*, and 184*c* of the first passage portion 172 and is shown in FIGS. 16 and 23, shall now be described. With the denomination-specific recovered coin separating unit 184*a*, an opening 188 is formed from the passage face 175 to the lower coin guide member 176 (to the coin guide member 177 in the case of each of the dispensed coin separating unit 186 and the denomination-specific separating units 187*d*, 187*c*, 187*b*, and 187*a* of the second passage portion 174), and inside the opening 188, a diverging member 189 is disposed in a manner enabling swinging in a front/rear direction about a shaft 190, parallel to a passage direction (conveying direction), as a supporting point.

The diverging member 189 has a supporting portion 191 supported by the shaft 190, a passing guide portion 192, allowing passage of coins of denominations that are not to be diverged, is disposed at an upper end of the support portion 191, and at a back portion of the support portion 191 is disposed a diverging guide portion 193, that takes in and diverges coins of a denomination to be diverged to a back side of the opening 188. A driving force of an unillustrated diverging motor is transmitted via an arm 194 to the supporting portion 191 of each diverging member 189, and the diverging member 189 is thereby switched between a passing position, at which the passing guide portion 192 is disposed at the opening 188, and a diverging position, at which the diverging guide portion 193 is disposed at the opening 188. The passing guide portion 192 has a passing groove 195, having a substantially square-C-like cross section as viewed from the passage direction and supporting and enabling a coin to pass, and in the passing position state shown in FIG. 23(*a*), a right face and a bottom face of the passing groove 195 are made substantially flush with the passage face 175 and a coin supporting edge portion 176*a* of the coin guide member 176 and allow passing of a coin by guiding a back face and a circumference at a lower portion of the coin. A left face of the passing groove 195 is provided with a dimension somewhat greater than the maximum coin thickness with respect to the right face to allow passing of coins. In the diverging position state shown in FIG. 23(*b*), the passing groove 195 is retracted to a top face side of the opening 188.

The diverging guide portion 193 has a tilted portion 196, having a substantially L-like cross section as viewed from the top face side and disposed in a tilted manner with respect to the first passage portion 172 so that an upper side thereof is disposed at an upstream side in the passage direction of the first passage portion 172, and a perpendicular portion 197, extending perpendicular to the passage direction of the first passage portion 172 from a lower side of the tilted portion 196. A notch 198, for preventing interference with projections 182 of the belt 181, is formed in the diverging guide portion 193. In the diverging position state shown in FIG. 23(*b*), the diverging guide portion 193 projects to the top face side from the passage face 175 and takes a coin, conveyed along the first passage portion 172, into the opening 188 through the tilted portion 196 and the perpendicular portion 197 and furthermore through a back side of the supporting portion 191. In the passing position state shown in FIG. 23(*a*), the tilted portion 196 and the perpendicular portion 197 are retracted to a back side of the opening 188.

Figure 24:
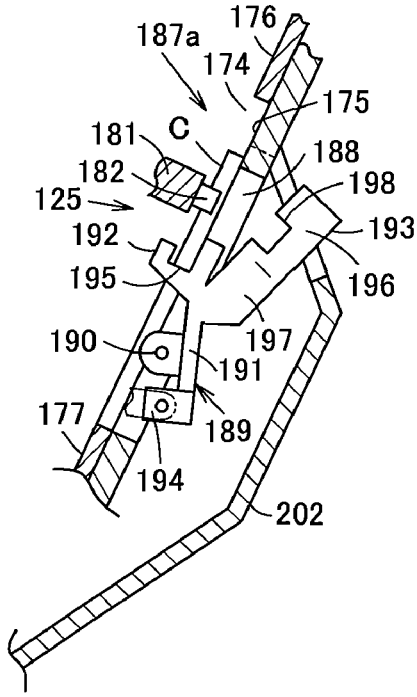
[FIG. 24] shows a denomination-specific separating unit of a second passage portion of the coin passage of the same coin depositing and dispensing machine, with (a) being a sectional view during passage of a coin and (b) being a sectional view during diverging of a coin.
Figure 24:
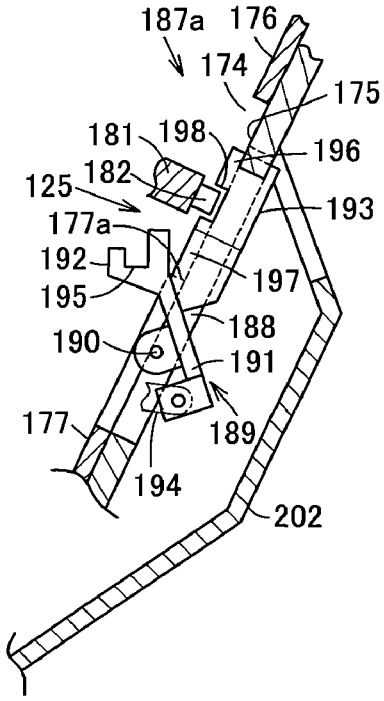

FIG. 24 shows the denomination-specific separating unit 187*a*, which is one of the dispensed coin separating unit 186 and the denomination-specific separating units 187*d*, 187*c*, 187*b*, and 187*a* of the second passage portion 174, and because this differs from the above-described denomination-specific recovered coin separating unit 184*a* only in direction corresponding to the difference in the conveying direction of the second passage portion 174 and the first passage portion 172 and is basically constituted to have the same structure, the same symbols shall be used and description thereof shall be omitted.

At back sides of the respective denomination-specific recovered coin separating units 184*a*, 184*b*, and 184*c* of the first passage portion 172 are disposed recovery chutes 200*a*, 200*b*, and 200*c*, respectively guiding coins, separated by the respective denomination-specific recovered coin separating units 184*a*, 184*b*, and 184*c*, to the recovering unit 130.

At a back side of the dispensed coin separating unit 186 of the second passage portion 174 is disposed a dispensing chute 201, guiding coins, separated by the dispensed coin separating unit 186, to the conveying unit 127.

At back sides of the denomination-specific separating units 187*d*, 187*c*, 187*b*, and 187*a* of the second passage portion 174 are disposed temporary storage chutes 202*a*, 202*b*, 202*c*, and 202*d*, respectively guiding coins, separated by the respective denomination-specific separating units 187*a*, 187*b*, 187*c*, and 187, to the respective denomination-specific temporary storage portions 129*a*, 129*b*, 129*c*, and 129*d*.

As shown in FIGS. 14 and 15, the conveying unit 127 has a lift 205, disposed at a position facing the top face side of the coin passage 125 at a front region inside the machine body 111, a bucket 206, receiving, accommodating, and conveying coins, is disposed inside the lift 205 in a manner enabling movement in a vertical direction, and the bucket 206 is moved in the vertical direction by an unillustrated drive mechanism.

The bucket 206 is enabled to receive and accommodate a plurality of dispensed coins and has an ejection port 208, opened and closed by a shutter 207, formed at one side, and a bottom portion of the bucket 206 is formed in tilting manner to guide coins toward the ejection port 208.

The bucket 206 has as stop positions, a dispensed coin receiving and accommodating position H1, which is a fixed position in an intermediate region in the vertical direction of lift 205 where dispensed coins, separated by the dispensed coin separating unit 186 and fed in through the dispensing chute 201, are received and accommodated, a dispensed coin ejection position H2, at an upper region of the lift 205 and at which dispensed coins are ejected to the coin ejection port 117, a dispensing-interrupted coin ejection position H3, at a region above the dispensed coin receiving and accommodating position H1 in the intermediate region in the vertical direction and at which dispensed coins are ejected when dispensing is interrupted, and a foreign object receiving and accommodating position H4, at a lower region of the lift 205 and at which a foreign object, ejected from the pooling and feeding unit 123, is received and accommodated, and moves to the respective positions.

At the dispensed coin ejection position H2 and the dispensing-interrupted coin ejection position H3 are disposed unillustrated shutter opening/closing mechanisms that open and close the shutter 207 of the bucket 206 when disposed at the respective positions.

An ejection chute 209, guiding dispensed coins, ejected from the bucket 206 at the dispensed coin receiving and accommodating position H1, to the coin ejection port 117, a dispensing-interrupted coin chute 210, guiding coins, ejected from the bucket 206 at the dispensing-interrupted coin receiving and accommodating position H3, to the pooling and feeding unit 123, and a foreign object chute 211, guiding a foreign object, ejected by opening of the movable hopper frame portion 139 of the pooling and feeding unit 123 and reverse rotation of the rotating disk 135, to the bucket 206 at the foreign object receiving and accommodating position H4, are also provided. The lift 205 is supported by a second movable frame 212, enabled to move between a housed position, inside the machine body 111, and an open position, which is outside the machine body 111 and is exposed to a front face side, that is, the customer operation surface 112 side. The second movable frame 212, for example, shares an outer casing with the lift 205, is swingably supported with respect to the machine body 111 by a plurality of upper and lower hinges 213, and is enabled to move between the housed position and the open position by the hinges 213. A lower face of the lift 205 is open, and a foreign object recovery box 214 is disposed below the lift 205 in a manner enabling attachment and detachment from the front side of the machine body 111. In a state where the bucket 206 is disposed above the foreign object receiving and accommodating position H4, a foreign object, ejected by opening of the movable hopper portion 139 and reverse rotation of the rotation disk 135, can be recovered in the foreign object recovery box 214.

The respective denomination-specific temporary storage portions 129*a*, 129*b*, 129*c*, and 129*d* are disposed at positions below the respective temporary storage chutes 202*a*, 202*b*, 202*c*, and 202*d* and facing the top face side of the coin passage 125 corresponding to positions above the respective accommodating and ejecting units 121*a*, 121*b*, and 121*c* and a recovery chute 217. The denomination-specific temporary storage portion 129*d* is disposed corresponding to an upper position between the accommodating and ejecting unit 121*c* and the pooling and feeding unit 123.

The respective denomination-specific temporary storage portions 129*a*, 129*b*, 129*c*, and 129*d* receive, accommodate, and temporarily store, in a non-aligned manner, coins, separated by the respective denomination-specific separating units 187*a*, 187*b*, 187*c*, and 187*d* and guided by the respective temporary storage chutes 202*a*, 202*b*, 202*c*, and 202*d*. At bottom portions of the respective denomination-specific temporary storage portions 129*a*, 129*b*, 129*c*, and 129*d*, unillustrated bottom plates are disposed in a manner enabling opening and closing and these bottom plates are opened and closed by unillustrated opening/closing mechanisms.

Coins ejected by the opening of the bottom plates of the respective denomination-specific temporary storage portions 129*a*, 129*b*, and 129*c* are received and accommodated by the respective accommodating and ejecting units 121*a*, 121*b*, and 121*c*. Coins ejected by the opening of the bottom plate of the denomination-specific temporary storage portion 129*d* are guided to the recovering unit 130 through the recovery chute 217, disposed between the accommodating and ejecting unit 121*c* and the pooling and storage unit 123.

The respective denomination-specific temporary storage portions 129*a*, 129*b*, 129*c*, and 129*d* are supported by a first movable frame 218, enabled to move between a housed position, inside the machine body 111, and an open position, which is outside the machine body 111 and is exposed to a left side. The first movable frame 218 is swingably supported with respect to a rear side of the machine body 111 by a plurality of hinges 219, and is enabled to move between the housed position and the open position by the hinges 219.

The recovering unit 130 includes denomination-specific recovering units 223*a*, 223*b*, and 223*c* for 500 yen, 10 yen, and 100 yen, respectively, that are disposed and aligned in the front/rear direction of the machine body 111 below the accommodating and ejecting units 121*a*, 121*b*, and 121*c*, and a denomination-specific recovering unit 223*d* for 50 yen, disposed next to a front side of the denomination-specific recovering unit 223*c*, and the respective denomination-specific recovering units 223*a*, 223*b*, 223*c*, and 223*d* are disposed in a manner enabling attachment and detachment from the rear side of the machine body 111.

The respective denomination-specific recovering units 223*a*, 223*b*, and 223*c* accommodate recovered coins, separated by the denomination-specific recovered coin separating units 184*a*, 184*b*, and 184*c* and guided by the recovery chutes 200*a*, 200*b*, and 200*c*, and recovered coins ejected by opening of the movable hopper portions 139, 139, and 139 of the accommodating and ejecting units 121*a*, 121*b*, and 121*c*.

The denomination-specific recovering unit 223*d* accommodates 50-yen coins, and in the depositing process, 50-yen coins are separated by the denomination-specific separating unit 187*d*, temporarily stored in the denomination-specific temporary storage portion 129*d*, ejected from the denomination-specific temporary storage portion 129*d* upon approval of depositing and upon non-approval of depositing, and accommodated upon being guided by the recovery chute 217.

The replenishing unit 131 has a coin replenishing frame 228, enabled, by a drawer guide 227 disposed in the machine body 111, to be housed inside the machine body 111 at an upper portion of the coin passage 125 in the machine body 111 and be drawn out to the rear of the machine body 111.

The coin replenishing frame 228 has a replenishment coin pooling hopper 229, which pools replenishment coins, is long corresponding to the front/rear direction of the machine body 111, and is open at upper and lower faces, and a replenishment coin conveyor 230 is disposed at a bottom face of the replenishment coin pooling hopper 229. The replenishment coin conveyor 230 carries replenishment coins on an upper face and is made to convey the replenishment coins to a front region by driving of an unillustrated driving mechanism.

At a front end of the coin replenishing frame 228 is disposed a replenishment coin pooling unit 231, accepting and pooling replenishment coins, fed to the front region by the replenishment coin conveyor 230, and feeding the coins one by one. Although the replenishment coin pooling unit 231 is reverse in the direction of tilt in the left/right direction and reverse in the coin feeding direction in the front/rear direction with respect to the accommodating and ejecting units 121*a*, 121*b*, and 121*c* and the pooling and feeding unit 123 described above, because it shares the same basic arrangement as the accommodating and ejecting units 121*a*, 121*b*, and 121*c* and the pooling and feeding unit 123, the same symbols shall be used and detailed description shall be omitted. In regard to a main arrangement, the rotating disk 135, which is put in a tilted orientation in which an upper portion is tilted toward a left direction as viewed from a front face, is rotatable about a rotational axis line, and receives and accommodates deposited coins, the hopper 136, pooling replenishment coins between itself and a top face of the rotating disk 135, etc. are provided. At an upper circumferential region of the rotating disk 135 is formed a replenishment coin feeding port 232, from which replenishment coins are fed one by one according to forward rotation of the rotating disk 135.

At the replenishment coin feeding port 232 of the replenishment coin pooling unit 231 is disposed a replenishment coin leading passage 233, by which replenishment coins, fed from the replenishment coin feeding port 232 are sent upward one by one in a spaced manner. Because the replenishment coin leading passage 233 shares the same basic arrangement as the respective dispensed coin leading passages 122*a*, 122*b*, and 122*c* and the deposited coin leading passage 124, the same symbols shall be used and description thereof shall be omitted. In regard to a main arrangement, the delivery circular plate 160, having the projection 164, etc. are provided.

In the coin replenishing frame 228, a replenishment coin passage 234, accepting, one by one, replenishment coins, fed from the replenishment coin pooling unit 231, through the replenishment coin leading passage 233 and conveying the coins to a rear region, is disposed along the front/rear direction. In the replenishment coin passage 234 is disposed a belt 235, with which coins, fed in one by one separately from the replenishment coin leading passage 233, are conveyed one by one separately, the belt 235 has the same projections as the projections 182 of the belt 181 of the coin passage 125, and the belt 235 is revolved in conjunction with the rotation of the delivery circular plate 160 by a driving mechanism in common to the delivery circular plate 160 of the replenishment coin leading passage 233. Replenishment coins, which are fed in one by one separately by the delivery circular plate 160 of the replenishment coin leading passage 233, are thus received between the projections in the longitudinal direction of the belt and each replenishment coin is conveyed singly and separately by being pushed by the projection disposed at a rear side in the conveying direction of the replenishment coin. A replenishment identifying unit 236, identifying the conveyed replenishment coins, is disposed in a front region of the replenishment coin passage 234.

In the replenishment coin passage 234, replenishment denomination-specific separating units 237*c*, 237*b*, and 237*a*, respectively separating 100-yen, 10-yen, and 500-yen replenishment coins according to denomination, are disposed, and a rejected replenishment coin separating unit 238 is disposed between the replenishment denomination-specific separating unit 237*b* and the replenishment denomination-specific separating unit 237*a*. Because the respective replenishment denomination-specific separating units 237*c*, 237*b*, and 237*a* and the rejected replenishment coin separating unit 238 are constituted to have the same structure as the dispensed coin separating unit 186 and the respective denomination-specific separating units 187*d*, 187*c*, 187*b*, and 187*a*, the same symbols shall be used and description thereof shall be omitted.

Replenishment denomination-specific temporary storage portions 239*c*, 239*b*, and 239*a*, respectively accepting replenishment coins, separated by the respective replenishment denomination-specific separating units 237*c*, 237*b*, and 237*a*, according to denomination and temporarily storing the coins in non-aligned states, are disposed at a lower portion of the replenishment coin passage 234. At bottom portions of the replenishment denomination-specific temporary storage portions 239*c*, 239*b*, and 239*a*, unillustrated bottom plates are disposed in a manner enabling opening and closing and these bottom plates are opened and closed by unillustrated opening/closing mechanisms.

Also at the machine 111 side are disposed denomination-specific replenishment chutes 240*c*, 240*b*, and 240*a*, respectively transferring replenishment coins in the respective replenishment denomination-specific temporary storage portions 239*c*, 239*b*, and 239*a* to the accommodating and ejecting units 121*c*, 121*b*, and 121*a* upon approval of replenishment. The replenishment chutes 240*c*, 240*b*, and 240*a* are supported by the first movable frame 218 along with the respective denomination-specific temporary storage portions 129*a*, 129*b*, 129*c*, and 129*d* and are made movable to housed positions inside the machine body 111 and open positions outside the machine body 111.

At a rear portion of the coin replenishing frame 228, a reject box 241, accommodating rejected replenishment coins, separated by the rejected replenishment coin separating unit 238, is disposed in a manner enabling attachment and detachment from the rear portion of the coin replenishing frame 228.

Operations of the fourth embodiment shall now be described. First, flows of coins in respective processes of the coin depositing and dispensing machine shall be described briefly. In a depositing process, deposited coins, input from the coin acceptance port 116, are received and accommodated in the pooling and feeding unit 123, the deposited coins are fed one by one separately from the pooling and feeding unit 123 to the deposited coin leading passage 124, the deposited coins are received one by one separately by the projection 164 of the delivery circular plate 160 of the deposited coin leading passage 124 and delivered to intervals between the projections 182 of the belt 181 of the coin passage 125, and by the projections 182 of the belt 181 of the coin passage 125, the deposited coins are conveyed one by one separately along the coin passage 125.

The deposited coins conveyed along the coin passage 125 are identified by the identifying unit 185. 500-yen, 10-yen, 100-yen, and 50-yen deposited coins that are identified as being normal as a result of identification are separated according to denomination by the denomination-specific separating units 187*a*, 187*b*, 187*c*, and 187*d* of the second passage portion 174 and temporarily stored in the denomination-specific temporary storage portions 129*a*, 129*b*, 129*c*, and 129*d*. 1-yen coins, 5-yen coins, and other coins outside the scope of depositing, unidentifiable coins, and other rejected deposited coins identified to be rejected coins are separated by the dispensed coin separating unit 186 and accommodated in the bucket 206 of the lift 205 put on standby in advance at the dispensed coin receiving and accommodating position H1.

After temporary storage of the deposited coins, etc. have been completed, if there are rejected deposited coins, the bucket 206 of the lift 205 is raised to the dispensed coin ejection position H2 and the rejected deposited coins in the bucket 206 are ejected to the coin ejection port 117 and returned.

When depositing is approved, the deposited coins, which are stored temporarily in the respective denomination-specific temporary storage portions 129*a*, 129*b*, and 129*c* and are 500-yen coins, 10-yen coins, and 100-yen coins that are used for dispensing, are accommodated according to denomination in the accommodating and ejecting units 121*a*, 121*b*, and 121*c*, and the deposited coins, which are stored temporarily in the denomination-specific temporary storage portion 129*d* and are 50-yen coins that are not used for dispensing, are recovered and accommodated in the denomination-specific recovering unit 223*d*, and the depositing process is thereby ended.

On the other hand, when depositing is disapproved, first, the deposited coins, stored temporarily in the respective denomination-specific temporary storage portions 129*a*, 129*b*, and 129*c*, are accommodated according to denomination in the accommodating and ejecting units 121*a*, 121*b*, and 121*c*, and the deposited coins, stored temporarily in the denomination-specific temporary storage portion 129*d*, are recovered and accommodated in the denomination-specific recovering unit 223*d*.

A money amount to be returned that is equivalent to a money amount of the temporarily stored deposited coins is returned as a combination of 500-yen, 10-yen, and 100-yen coins. That is, deposit return coins are fed one denomination at a time from the accommodating and ejecting units 121*a*, 121*b*, and 121*c* of denominations corresponding to the deposit return. That is, the delivery circular plates 160, 160, and 160 of accommodating and ejecting units 121*a*, 121*b*, and 121*c* and the belt 181 of the coin passage 125 are respectively rotated, and the rotating disks 135, 135, and 135 of the accommodating and ejecting units 121*a*, 121*b*, and 121*c* are rotated sequentially one denomination at a time. The deposit return coins are thereby fed one denomination at a time and one by one separately from the accommodating and ejecting units 121*a*, 121*b*, and 121*c* to the respective dispensed coin leading passages 122*a*, 122*b*, and 122*c*, the deposit return coins are received one by one separately by the projecting bodies 164 of the delivery circular disks 160 of the respective dispensed coin leading passages 122*a*, 122*b*, and 122*c* and delivered to intervals between the projections 182 of the belt 181 of the coin passage 125, and the deposit return coins are conveyed one by one separately along the coin passage 125 by the projections 182 of the belt 181 of the coin passage 125.

The deposit return coins conveyed along the coin passage 125 are identified and counted by the identifying unit 185, separated by the dispensed coin separating unit 186, and accommodated in the bucket 206 of the lift 205 put on standby in advance at the dispensed coin receiving and accommodating position H1. When the deposit return coins corresponding to the money amount to be returned have been identified by the identifying unit 185 and it is detected that the coins have been separated by the dispensed coin separating unit 186, the bucket 206 of the lift 205 is raised from the fixed position of the dispensed coin receiving and accommodating position H1 to the dispensed coin ejection position H2 and the deposit return coins inside the bucket 206 are ejected to the coin ejection port 117 and returned.

In a dispensing process, a money amount corresponding to a dispensed monetary amount is dispensed as a combination of 500 yens, 10 yens, and 100 yens, and dispensed coins are fed sequentially, one denomination at a time, from the accommodating and ejecting units 121*a*, 121*b*, and 121*c* of the denominations corresponding to the dispensation. The order of feeding is preferably in the order of being close to the identifying unit 185, that is, in the order of the accommodating and ejecting units 121*c*, 121*b*, and 121*a*. This is because transition to coin feeding of the next denomination can thereby be performed rapidly. In this process, the delivery circular plates 160 of the dispensed coin leading passages 122*a*, 122*b*, and 122*c* and the belt 181 of the coin passage 125 are respectively rotated, and the rotating disks 135, 135, and 135 of the accommodating and ejecting units 121*a*, 121*b*, and 121*c* of the denominations corresponding to the dispensation are rotated sequentially one denomination at a time. The dispensed coins are thereby fed one denomination at a time and one by one separately from the accommodating and ejecting units 121*a*, 121*b*, and 121*c* to the respective dispensed coin leading passages 122*a*, 122*b*, and 122*c*, the dispensed coins are received one by one separately by the projecting bodies 164 of the delivery circular disks 160 of the respective dispensed coin leading passages 122*a*, 122*b*, and 122*c* and delivered to intervals between the projections 182 of the belt 181 of the coin passage 125, and the dispensed coins are conveyed one by one separately along the coin passage 125 by the projections 182 of the belt 181 of the coin passage 125. The dispensed coins conveyed along the coin passage 125 are identified by the identifying unit 185, the normal dispensed coins are separated by the dispensed coin separating unit 186 and accommodated and temporarily stored in the bucket 206 of the lift 205 put on standby in advance at the dispensed coin receiving and accommodating position H1.

Dispensation rejected coins that are dispensation-unsuitable coins confirmed not to be normal by the identifying unit 185 pass through the dispensation coin separating unit 186, are separated by the denomination-specific separating units 187*a*, 187*b*, 187*c*, and 187*d* of the corresponding denominations, and are then temporarily stored in the respective denomination-specific temporary storage portions 129*a*, 129*b*, 129*c*, and 129*d*. When dispensation rejected coins are found, dispensed coins of the corresponding denominations are fed again from the accommodating and ejecting units 121*a*, 121*b*, and 121*c*. When the dispensed coins of the money amount corresponding to the dispensed monetary amount have been identified by the identifying unit 185 and it is detected that the coins have been separated by the dispensed coin separating unit 186, the bucket 206 of the lift 205 is raised to the dispensed coin ejection position H2 and the dispensed coins inside the bucket 206 are ejected to the coin ejection port 117 and dispensed.

In the case where there are dispensation rejected coins, the dispensation rejected coins, stored temporarily in the denomination-specific temporary storage portions 129*a*, 129*b*, and 129*c*, are accommodated, by opening of the bottom plates at the lower portions, into the accommodating and ejecting units 121*a*, 121*b*, and 121*c*.

In regard to the replenishing process, although there is an initial replenishment for a case where coins are not accommodated in the machine body 111 and an intermediate replenishment for a case where coins in the machine body 111 have decreased, the same process is performed in both cases.

The coin replenishing frame 228 is drawn out to the rear region of the machine body 111, replenishment coins are input into the replenishment coin pooling hopper 229 and the coin replenishing frame 228 is housed inside the machine body 111. The replenishment coins shall be 500-yen coins, 10-yen coins, and 100-yen coins to be used for dispensing.

The replenishment coins in the replenishment coin pooling hopper 229 are fed at suitable amounts at a time into the replenishment coin pooling unit 231 by the replenishment coin conveyor 230, the replenishment coins are then fed one by one separately from the replenishment coin pooling unit 231 to the replenishment coil leading passage 233, the replenishment coins are received one by one separately by the projection 164 of the delivery circular plate 160 of the replenishment coin leading passage 233 and delivered to intervals between the projections of the belt 235 of the replenishment coin passage 234, and by the projections of the belt 235 of the replenishment coin passage 234, the deposited coins are conveyed one by one in the separated states along the replenishment coin passage 234.

The replenishment coins conveyed along the replenishment coin passage 234 are identified by the replenishment identifying unit 236.

The 500-yen, 10-yen, and 100-yen replenishment coins that are identified as being normal as a result of identification by the replenishment identifying unit 236 are separated according to denomination by the replenishment denomination-specific separating units 237*a*, 237*b*, and 237*c* and temporarily stored in the respective replenishment denomination-specific temporary storage portions 239*a*, 239*b*, and 239*c*.

1-yen coins, 5-yen coins, and other coins outside the scope of replenishment, unidentifiable coins, and other rejected replenishment coins identified to be rejected coins as a result of identification by the replenishment identifying unit 236 are separated by the rejected replenishment coin separating unit 238 and accommodated in the reject box 241.

In accordance with a replenishment coin accommodation command, the 500-yen, 10-yen, and 100-yen replenishment coins, temporarily stored in the respective replenishment denomination-specific temporary storage portions 239*a*, 239*b*, and 239*c* are ejected, by opening of the bottom plates (not shown), from the respective replenishment denomination-specific temporary storage portions 239*a*, 239*b*, and 239*c* and accommodated in the accommodating and ejecting units 121*a*, 121*b*, and 121*c* through the replenishment chutes 240*a*, 240*b*, and 240*c*.

With the coin depositing and dispensing machine with the above arrangement, because each of the accommodating and ejecting units 121*a*, 121*b*, and 121*c* is constituted of the rotating disk 135 and the hopper 136, there is no need to accommodate the coins in an aligned, stacked manner as in a denomination-specific coin pooling cylinder and the coins can thus be accommodated easily in a non-aligned state, the coins in the accommodating and ejecting units 121*a*, 121*b*, and 121*c* can be sent rapidly one by one from the respective dispensed coin leading passages 122*a*, 122*b*, and 122*c* to the coin passage 125 and identified, and just the dispensed coins that are judged to be coins suitable for dispensing can be sent rapidly to the coin ejection port 117. Furthermore, deposited coins can be used as dispensed coins, and when the dispensed coins, upon being stored temporarily, are sent to the accommodating and ejecting units 121*a*, 121*b*, and 121*c*, the coins do not need to be accommodated in an aligned, stacked manner and the coins can be accommodated easily in a non-aligned state. Moreover, by configuration of the respective components in the front/rear direction of the machine body 111, the coin depositing and dispensing machine can be made to have a favorable configuration enabling, for example, both customers and clerks to operate the machine with ease.

In the conveying unit 127, coins suitable for dispensing can be sent rapidly to the coin ejection port 117 by the bucket 206 and the leaving of coins can be lessened in comparison to conveying by a belt.

Also by configuring the coin passage 125 from the first passage portion 172, the return passage portion 173, and the second passage portion 174, the length in the direction along the first and second passage portions 172 and 174 can be made short and yet, by the dispensed coin separating unit 186, disposed between the terminal end of the first passage portion 172 and the starting end of the second passage portion 174, just the coins suitable for dispensing can be separated reliably and the coins unsuitable for dispensing can be separated in the second passage portion 174.

A feeding and separating conveying operation of coins from the accommodating and ejecting unit 121*a* to the coin passage 125 shall now be described with reference to FIGS. 25 to 27.

Figure 25:
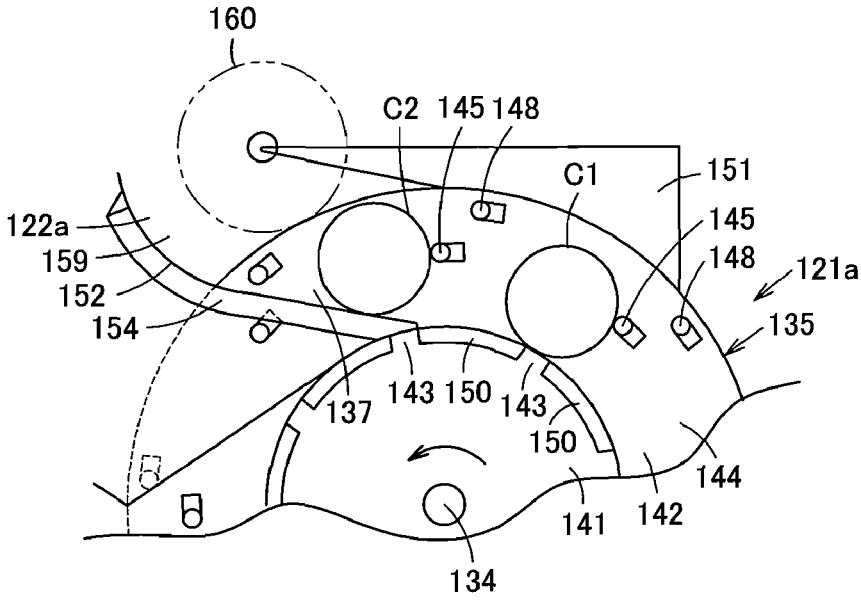
[FIG. 25] is an explanatory diagram for describing an operation of feeding a coin from an accommodating and ejecting unit to a dispensed coin leading passage and the coin passage of the same coin depositing and dispensing machine.

As shown in FIG. 25, by forward rotation of the rotating disk 135, a coin (C1), a back face of which is retained by the coin face retaining portion 144 at the lower region of the accommodating and ejecting unit 121*a*, is retained between the coin circumference retaining portion 143 and the picking-up member 145, picked up to the upper region of the rotating disk 135, and fed into the dispensed coin feeding port 137.

In this process, even if a plurality of coins are picked up overlappingly in a bridge-like form between the coin circumference retaining portion 143 and the picking-up member 145, only a single coin is retained between the coin circumference retaining portion 143 and the picking-up member 145 and the coins overlapping in the bridge-like form drop. In particular, because the sliding portions 150 are disposed between the plurality of coin circumference retaining portions 143 in the circumferential direction, the coins that are overlapped in the bridge-like form drop reliably at an early point in time through the sliding portions 150. Just a single coin can thus be retained between the coin circumference retaining portion 143 and the picking-up member 145 and fed into the dispensed coin feeding port 137 and jamming of coins between the coin circumference retaining portion 143 and the picking-up member 145 can be prevented near the dispensed coin feeding port 137.

A coin (C2), picked up to the upper region of the rotating disk 135 and sent to the dispensed coin feeding port 137 is received in the coin guide member 152 from the coin circumference retaining portion 143, and the single coin is retained between the coin guide member 152 and the picking-up member 145 and fed from the dispensed coin feeding port 137 toward the dispensed coin leading passage 122*a* at the outer side of the circumference of the rotating disk 135.

Because in this process, the thickness-direction regulating guide portion 154 of the coin guide member 152 makes, from among coins that are sent in a multi-layered state in the thickness direction, just a single layer of the coin in contact with the coin face retaining portion 144 be fed to the dispensed coin leading passage 122*a* and the remaining coins are made to slide down, coins can be conveyed one by one separately to the dispensed coin leading passage 122*a* and the occurrence of jamming of coins near the dispensed coin ejection port 137 can be prevented. Because the coins that are made to slide down from the thickness-direction guiding portion 154 are received and accommodated in the accommodating and ejecting unit 121*a*, the slid coins can also be fed.

Figure 26:
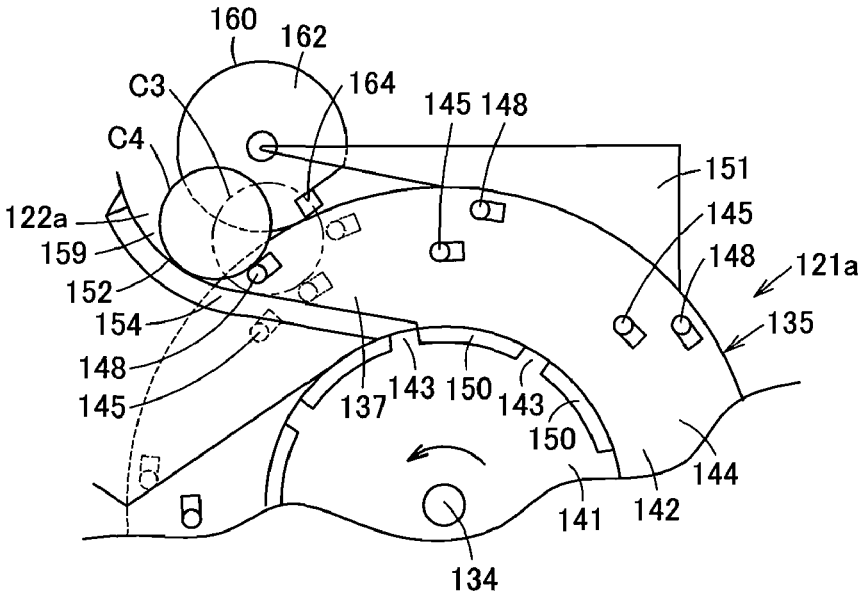
[FIG. 26] is an explanatory diagram for describing a coin feeding operation continuing from FIG. 25 of the same coin depositing and dispensing machine.

As shown in FIG. 26, a coin (C3), fed from the dispensed coin feeding port 137 to the dispensed coin leading passage 122*a* is fed while being retained between the picking-up member 148, to which the coin is fed from the picking-up member 145, and the coin guide member 152. A coin (C4), fed from the dispensed coin feeding port 137 to the dispensed coin leading passage 122*a* while being retained between the picking-up member 148 and the coin guide member 152, is delivered to the projection 164 of the delivery circular plate 160.

In this process, even if a bridge of coins forms between the coin guide member 152 and the picking-up member 145 in a region leading from the rotating disk 135 to the dispensed coin feeding port 137 that feeds coins outward or in a region near the dispensed coin feeding port 137, the bridge can be collapsed by the picking-up member 148 serving in common as a coin collapsing member and jamming of coins can thus be prevented. Also, even if the projection 164 of the delivery circular plate 160 bites into a coin that stays between the projection 164 and the coin guide member 152, because the projection 164 is enabled to be retracted into the rotational face portion 162 against the urging by the spring, jamming of coins can be prevented.

Figure 27:
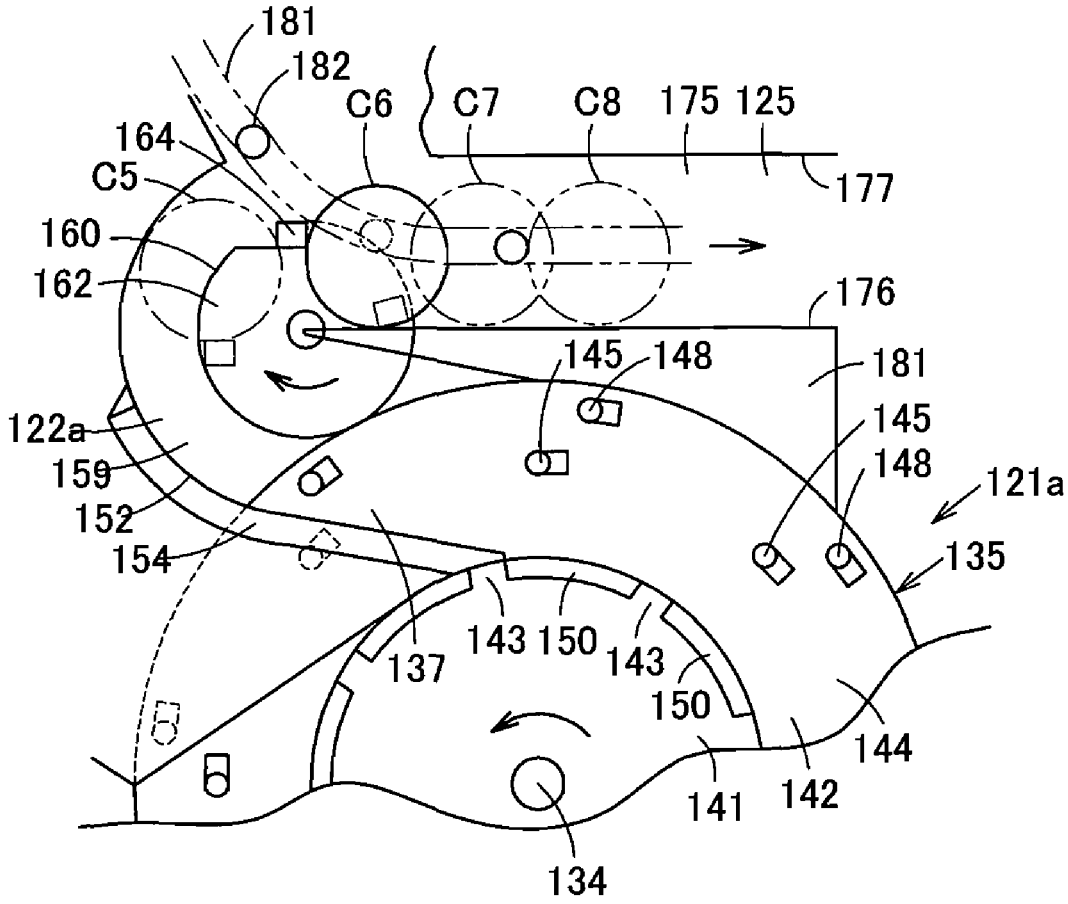
[FIG. 27] is an explanatory diagram for describing a coin feeding operation continuing from FIG. 26 of the same coin depositing and dispensing machine.

As shown in FIG. 27, a coin (C5) fed to the dispensed coin leading passage 122*a* is conveyed along the dispensed coin leading passage 122*a* of substantially U-like shape while being pushed by the projection 164 of the delivery circular plate 160, and the conveying direction of the coin C5 is changed from the leftward direction to the upward direction and to the rightward direction. A coin (C6), conveyed to a starting end region of the coin passage 125 by being pushed by the projection 164 of the delivery circular plate 160, enters between the passage face 159 and the belt 181 and between the projections 182 in the longitudinal direction of the belt 181.

After conveying a coin (C7) to the starting end region of the coin passage 125, the projection 164 of the delivery circular plate 160 separates from the coin (C7) and proceeds to receive the next coin fed from the dispensed coin feeding port 137. The projection 182 of the belt 181 contacts a coin (C8), separated from the projection 164 of the delivery circular plate 160, and the coin (C8) is conveyed along the coin passage 125 by being pushed by the projection 182.

A single coin is thus retained on the top face of the rotating disk 135 by the coin circumference retaining portion 143, the coin face retaining portion 144, and the picking-up member 145 and picked up to the upper region of the rotating disk 135, and because the coin received between the picking-up member 145 and the coin guide member 152 from the coin circumference retaining portion 143 at the upper region of the rotating disk 135 is fed from the dispensed coin feeding port 137 to the outer side of the circumference of the rotating disk 135, the coin can be fed reliably.

Moreover, because by the delivery circular plate 160 having the projection 164, the coins fed from the dispensed coin feeding port 137 are conveyed one by one separately to a subsequent stage, the coins can be sent reliably to the coin passage 125 at the subsequent stage.

Not just the accommodating and ejecting unit 121*a* but the other accommodating and ejecting units 121*b* and 121*c*, the pooling and feeding unit 123, and the replenishment coin pooling unit 231 that have the same structure as the accommodating and ejecting unit 121*a* also exhibit the same operations and effects.

Figure 28:
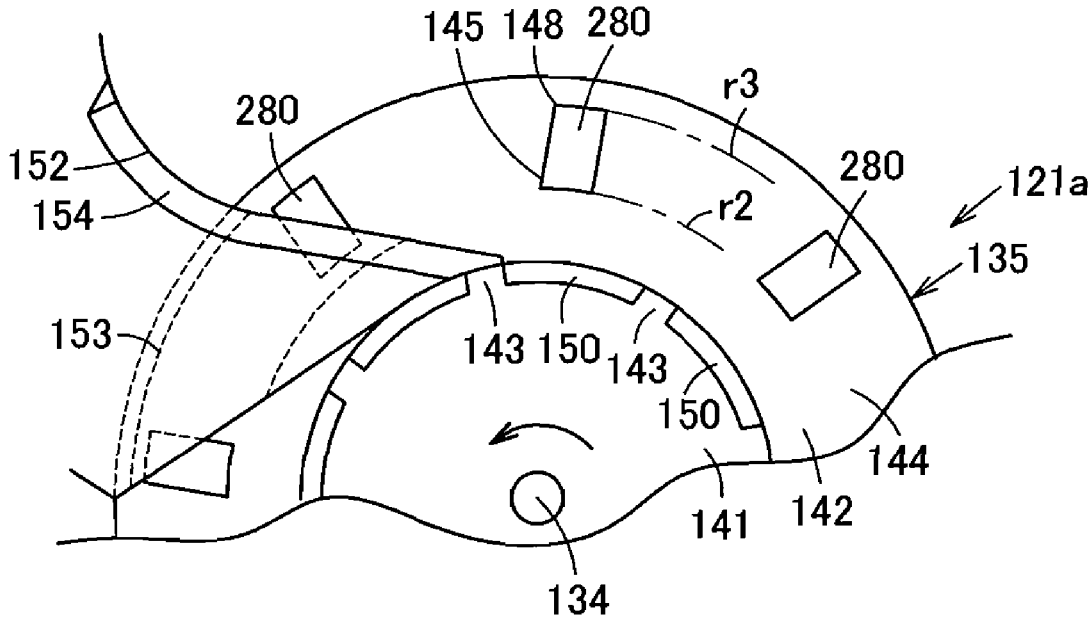
[FIG. 28] shows a picking-up member and a coin member of a rotating disk of a coin depositing and dispensing machine according to a fifth embodiment of the present invention, with (a) being a front view and (b) being a sectional view.
Figure 28:
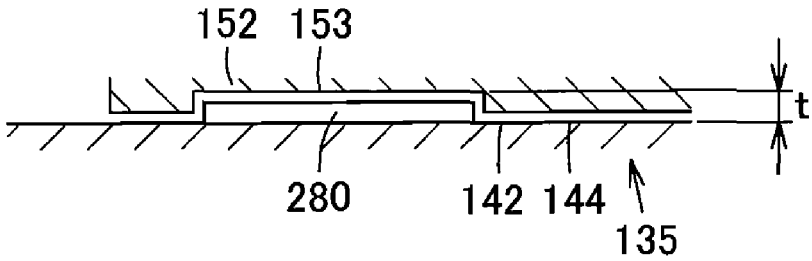

A fifth embodiment is shown in FIG. 28.

The present embodiment is another example of the picking-up member, and on the rotating disk 135, projections 280, projecting toward the top face side of the rotating disk 135 by a dimension less than the minimum coin thickness, are fixedly disposed singly along radial directions at a predetermined pitch in the circumferential direction in a range from the second predetermined radial region r2 to the third predetermined radial region r3 from the rotational axis 134 that is the rotational axis line in the coin face retaining portion 144. Each projection 280 is thus integrally provided with the functions of both the picking-up member 145 and the picking-up member 148 that serves in common as a coin collapsing member.

Corresponding to the projections 280, the groove portion 153 of the coin guide member 152 is also formed singly along a radial direction. An interval t between the groove portion 153 and the coin face retaining portion 144 is set to a dimension less than the minimum coin thickness of the processed coins to prevent a coin from entering into the groove portion 153.

Figure 29:
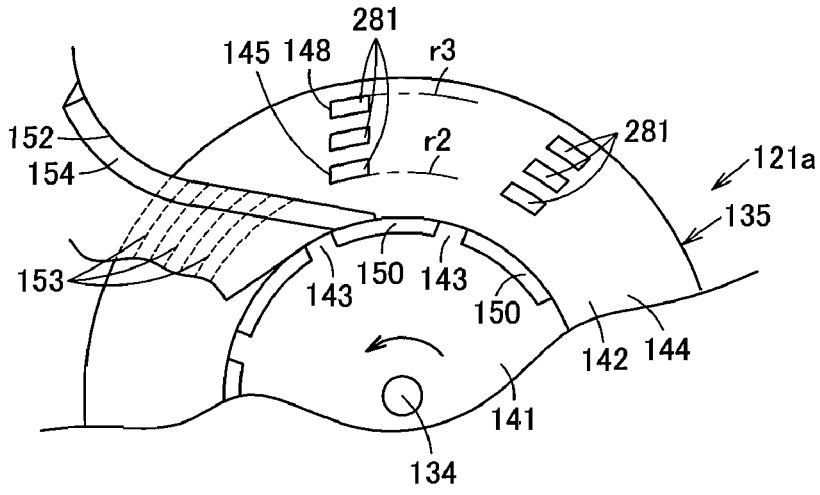
[FIG. 29] shows a picking-up member and a coin member of a rotating disk of a coin depositing and dispensing machine according to a sixth embodiment of the present invention, with (a) being a front view and (b) being a sectional view.
Figure 29:
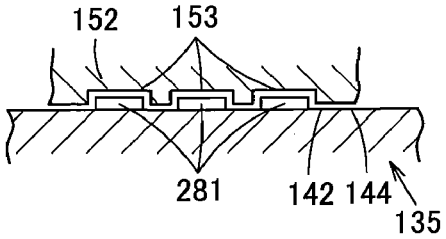

A sixth embodiment is shown in FIG. 29.

The present embodiment is also another example of the picking-up member, and on the rotating disk 135, projections 281, projecting toward the top face side of the rotating disk 135, are fixedly disposed in threes along radial directions at a predetermined pitch in the circumferential direction in a range from the second predetermined radial region r2 to the third predetermined radial region r3 from the rotational axis 134 that is the rotational axis line in the coin face retaining portion 144. The three projections 281 in a radial direction are provided with the functions of both the picking-up member 145 and the picking-up member 148 that serves in common as a coin collapsing member. Corresponding to the projections 281, the groove portions 153 of the coin guide member 152 are formed as a set of three along a radial direction. The groove portions 153 are narrow in width and a coin cannot enter into the groove portions 153.

The projections 281 may be disposed in sets of three or more in radial directions.

Figure 30:
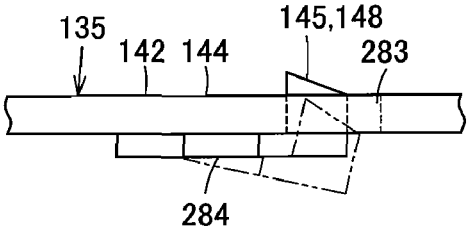
[FIG. 30] is a side view of a picking-up member of a rotating disk of a coin depositing and dispensing machine according to a seventh embodiment of the present invention.

A seventh embodiment is shown in FIG. 30.

Holes 283, enabling the respective picking-up members 145 and the respective picking-up members 148 to retractably project from the back side to the top face side, are formed in the rotating disk 135, and on the back face side of the rotating disk 135 are disposed plate springs 284 that support and make the respective picking-up members 145 and the respective picking-up members 148 project to the top face side of the rotating disk 135.

When during forward rotation of the rotating disk 135, an excessive force is applied to a picking-up member 145 or a picking-up member 148 in contact with a coin, the picking-up member 145 or the picking-up member 148 is enabled to retract to the back face side of the rotating disk 135 against the urging of the plate spring 284, thereby enabling the occurrence of jamming of coins to be prevented.

Figure 31:
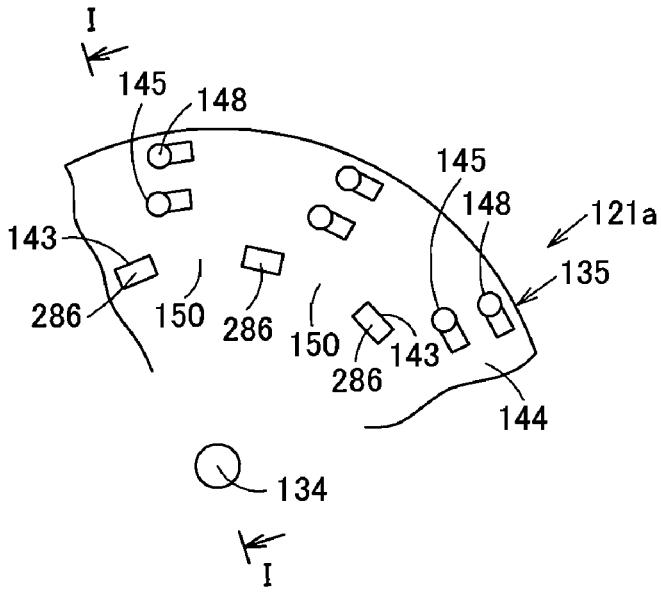
[FIG. 31] shows a rotating disk of a coin depositing and dispensing machine according to an eighth embodiment of the present invention, with (a) being a front view and (b) being a sectional view taken on line I-I of (a).
Figure 31:
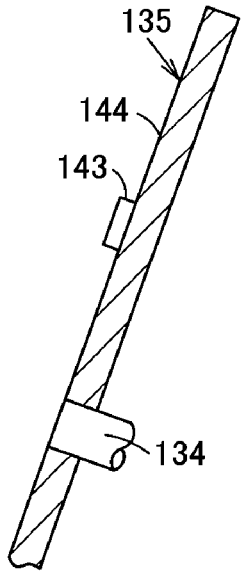

An eighth embodiment is shown in FIG. 31.

The top face side of the rotating disk 135 is formed to a flat shape that is flush with the coin face retaining portion 144, the coin circumference retaining portions 143 are formed as coin face retaining projections 286 projecting to the front face side of the rotating disk 135, and the sliding portions 150 are formed between the coin face retaining projections 286 in the circumferential direction.

With the respective embodiments described above, the coin ejection port 117, that is the coin dispensing port is not restricted to being constituted separately from the coin acceptance port 116 and may be constituted to be the same as the coin acceptance port 116.

The recovering unit 130 is not restricted to denomination-specific recovery and collective recovery may be performed instead.

In regard to each of the accommodating and ejecting units 121*a*, 121*b*, and 121*c*, the pooling and ejection unit 123, and the replenishment coin pooling unit 231, the rotating disk 135 may have the rotational axis 134 or does not have to have the rotational axis 134. In the case where the rotating disk 135 does not have the rotational axis 134, a plurality of rollers, serving in common to position and retain the orientation of the rotating disk 135, and a drive roller for rotating the rotating disk 135 are disposed at the circumference of the rotating disk 135.

On the rotating disk 135, the coin circumference retaining portions 143 may be formed across the entire circumference without forming the sliding portions 150.

The open-and-closeable movable hopper portion 139 of the hopper 136 of each of the accommodating and ejecting units 121*a*, 121*b*, and 121*c* and the pooling and ejection unit 123 is not restricted to be a lower region of the hopper 136 and may instead be the entirety of the hopper 136.

Although the delivery circular plates 160, 160, 160, and 160 are driven by a driving mechanism in common, the respective delivery circular plates 160, 160, 160, and 160 may instead be driven by independent driving mechanisms. The rotating disks 135, 135, and 135 of the accommodating and ejecting units 121*a*, 121*b*, and 121*c* may be driven by a single driving mechanism, and a drive transmission electrical clutch may be interposed between the driving mechanism and the rotating disks 135, 135, and 135. Also, because the structure of the rotating disks 135, 135, and 135 of the accommodating and ejecting units 121*a*, 121*b*, and 121*c* and the structure of the respective delivery circular plates 160, 160, and 160 are exactly the same in dimensions, the denomination types of the accommodating and ejecting units 121*a*, 121*b*, and 121*c* can be set freely. In particular, it is efficient and favorable in terms of the treatment of coins to position, in accordance with the market of the processed coins, the denomination of the highest depositing and dispensing amounts at the downstream side of the coin passage 125, that is, at a position close to the identifying unit 185 and to perform processing in the order of the accommodating and ejecting units 121*a*, 121*b*, and 121*c* of denominations close to the identifying unit 185. The accommodating and ejecting units 121*a*, 121*b*, and 121*c* may however be matched to denomination-specific dimensions.

The present invention is used, for example, in a cash register in a store, or in a case of a financial institution, at a counter or in an ATM (automatic teller machine), etc., installed inside or outside a financial outlet.

The invention claimed is:

1. A coin depositing and dispensing machine comprising:

a coin acceptance port, accepting coins from an outside of a machine body;

a coin ejection port, from which coins are ejected to the outside of the machine body;

a conveying device, having a coin passage which is common to conveying coins accepted in the coin acceptance port and to conveying coins to be ejected to the coin ejection port, and conveying, one by one, coins in the common coin passage;

an identifying unit, identifying types of coins conveyed by the conveying device; and a plurality of accommodating and ejecting units, having a rotating disk, rotatable in a tilted orientation in which an upper portion is tilted toward a back face direction, a hopper, accommodating coins at a top face side of the rotating disk, and a coin outlet, through which coins are sent out from an upper circumferential region of the rotating disk to the common coin passage of the conveying device, and the accommodating and ejecting units accepting, in accordance with identification results of the identifying unit, coins accepted in the coin acceptance port from the outside of the machine body, accommodating the accepted coins in a non-aligned state according to type, and ejecting the accommodated coins, one by one, from the coin outlet.

2. A coin depositing and dispensing machine comprising:

a coin acceptance port, accepting coins from the outside of the machine body;

a coin ejection port, from which coins are ejected to the outside of the machine body;

a conveying device, having a coin passage which is common to conveying coins accepted in the coin acceptance port and to conveying coins to be ejected to the coin ejection port, and conveying, one by one, coins in the common coin passage;

an identifying unit, identifying types of coins conveyed by the conveying device; and an accommodating and ejecting unit, having a coin outlet/inlet through which coins are output or input to or from the common coin passage of the conveying device, accepting, in accordance with identification results of the identifying unit, coins accepted in the coin acceptance port from the outside of the machine body, accommodating the accepted coins in a non-aligned state, and ejecting the accommodated coins, one by one, from the coin outlet/inlet.

3. A coin depositing and dispensing machine according to claim 2, further comprising:

a pooling and feeding unit, receiving, accommodating, and pooling coins, accepted into the coin accepting port from the outside of the machine body, and feeding the pooled coins one by one to the conveying device.

4. A coin depositing and dispensing machine according to claim 3, further comprising:

a controller, driving the conveying device in a first direction when coins are fed from the pooling and feeding unit and accommodated in the accommodating and ejecting unit, and driving the conveying device in a second direction, different from the first direction, when coins are fed from the accommodating and ejecting unit and ejected to the coin ejection port.

5. A coin depositing and dispensing machine according to claim 4. wherein the conveying device comprises: a first passage portion, disposed from one side toward another side of the machine body; a return passage portion, returning from a terminal end of the first passage portion toward the one side of the machine body; and a second passage portion, disposed from a terminal end of the return passage portion toward the one side of the machine body and having a terminal end facing the coin ejection port;

the identifying unit is disposed in the first passage portion, and a plurality of the accommodating and ejecting units are disposed in the first passage portion at a downstream side in the conveying direction with respect to the identifying unit when the conveying device is driven in the first direction.

6. A coin depositing and dispensing machine according to claim 5, wherein an accommodating and ejecting unit is also disposed in the second passage portion.

7. A coin depositing and dispensing machine according to claim 5 wherein the identifying unit is disposed in the first passage portion, and a rejection sorting mechanism, sorting out coins not identified as being normal coins according to the identification result of the identifying unit, is disposed at a downstream side in a conveying direction from the identifying unit when the conveying device is driven in the first direction.

8. A coin depositing and dispensing machine according to claim 3, further comprising:

a memory unit, memorizing numbers of coins according to type; and a controller, performing, with the pooling and feeding unit and the accommodating and ejecting unit, mutually between which coins can be moved by the conveying device and through the identifying unit, a detailed check of a number of coins accommodated in the accommodating and ejecting unit by making coins be fed one by one from the accommodating and ejecting unit, the fed coins be identified by the identifying unit and memorized by the memory unit, and identified coins be accommodated in the pooling and feeding unit, and, after all of the coins in the accommodating and ejecting unit have been moved to the pooling and feeding unit, all of the coins in the pooling and feeding unit be fed one by one and accommodated back in the accommodating and ejecting unit.

9. A coin depositing and dispensing machine according to claim 2, further comprising: a temporary storage unit, temporarily storing coins; and a controller, making coins, which, among the coins accepted into the coin accepting port from the outside of the machine body, are identified as normal coins by the identifying unit, be temporarily stored in the temporary storage unit until approval and confirmation of depositing and making stored coins be fed from the temporary storage unit after approval and confirmation of depositing.

10. A coin depositing and dispensing machine according to claim 2 and further comprising:

a sorting member, sorting coins, conveyed by the conveying device, with respect to the accommodating and ejecting unit in accordance with the identification results of the identifying unit.

11. A coin depositing and dispensing machine according to claim 2, wherein the conveying device comprises: a cyclic coin passage; and an endless conveyor, enabled to move along the coin passage and having a plurality of projections, pushingly conveying coins one by one in the coin passage.

* * * * *